US009849664B2

(12) United States Patent
Takahashi et al.

(10) Patent No.: US 9,849,664 B2
(45) Date of Patent: Dec. 26, 2017

(54) THERMAL STENCIL MAKING UNIT

(71) Applicant: RISO KAGAKU CORPORATION, Tokyo (JP)

(72) Inventors: Dai Takahashi, Ibaraki (JP); Kazuo Nakano, Ibaraki (JP); Shigeyuki Chuugun, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/447,515

(22) Filed: Mar. 2, 2017

(65) Prior Publication Data

US 2017/0274662 A1 Sep. 28, 2017

(30) Foreign Application Priority Data

Mar. 24, 2016 (JP) ..... 2016-059631
Jul. 25, 2016 (JP) ..... 2016-145340

(51) Int. Cl.
*B41C 1/14* (2006.01)
*B41J 2/32* (2006.01)

(52) U.S. Cl.
CPC ..... *B41C 1/144* (2013.01)

(58) Field of Classification Search
CPC ..... B41J 1/14; B41J 1/144; B41J 2/32; B41J 2/335
See application file for complete search history.

(56) References Cited

U.S. PATENT DOCUMENTS

2011/0193927 A1* 8/2011 Matsushima ..... B41J 2/32 347/218
2016/0339685 A1* 11/2016 Nakajima ..... B41D 1/06

FOREIGN PATENT DOCUMENTS

JP 10-138534 5/1998

* cited by examiner

*Primary Examiner* — Huan Tran
(74) *Attorney, Agent, or Firm* — Greenblum & Bernstein, P.L.C.

(57) ABSTRACT

A thermal stencil making unit that makes a stencil of a perforated image on a thermal gauze by moving a thermal print head having the plurality of heat elements relative to the thermal gauze tightly stretched in a gauze frame detachably set in a unit housing, includes a head-protecting member that moves between a protection position where the thermal print head is protected and a protection release position where a protective state is released. The thermal stencil making unit moves the head-protecting member to the protection position when the gauze frame is not set in the unit housing and moves the head-protecting cover member from the protection position to the protection release position, in conjunction with an operation of setting the gauze frame in the unit housing.

6 Claims, 22 Drawing Sheets

72
72A
72B
73
74
75
XIIID

THERMAL STENCIL MAKING UNIT

BACKGROUND

1. Technical Field

The present invention relates to a thermal stencil making unit that makes a stencil of a perforated image on a thermal gauze by a thermal print head while relatively moving the thermal gauze tightly stretched in a gauze frame and the thermal print head, and that includes a head protecting member for protecting the thermal print head when the gauze frame is set.

2. Related Art

Generally, because of having a simple structure and allowing a simple stencil making operation, there is widely used a thermal stencil making unit that makes a screen stencil by heating and perforating image information in a heat-sensitive film of a thermal gauze through the use of a plurality of heat elements provided in the thermal print head by relatively moving: the thermal gauze in which the thermal film is stuck with an adhesive agent onto the gauze tightly stretched in the gauze frame and having a plurality of meshes by weaving warps and woofs; and the thermal print head having, on its surface, a plurality of the heat elements for heating and perforating this thermal gauze.

In addition, an image is screen-printed on a sheet or a T-shirt by dropping ink onto the screen plate on which a stencil is made by the thermal stencil making unit.

As an example of this type of the thermal stencil making unit, there is known a thermal stencil making unit using a thermal print head in which a surface portion of the thermal print head can be protected by a head protective plate when the gauze frame is replaced (for example, refer to Patent Document 1).

In the thermal stencil making unit using the thermal print head disclosed in Patent Document 1, the gauze frame in which the thermal gauze is tightly stretched is detachably fixed to a stencil making unit body, although not shown here.

Furthermore, a platen roller is provided below the thermal gauze in the stencil making unit body. On the other hand, above the stencil making unit body, a thermal print head portion in which the thermal print head is mounted on a thermal print head supporting member is openably and closably mounted above the thermal gauze.

At this time, the platen roller and the thermal print head portion are movably provided by being guided by a pair of guide rails.

In addition, when a stencil is made, the platen roller and the thermal print head are moved while the thermal gauze is sandwiched between the platen roller and the thermal print head in a pressure-contact manner, and thereby a stencil of the perforated image is made on the thermal gauze.

Furthermore, a pair of plate supporting members that support the head protective plate for protecting the surface portion of the thermal print head are rotatably mounted on the thermal print head supporting member of the thermal print head portion.

The pair of these plate supporting members also have a function as an operation lever of the head protective plate and is constituted so as to selectively open/close the surface portion of the thermal print head by rotating the head protective plate via the pair of plate supporting members.

With the configuration described above, when the thermal print head is to be used with the thermal print head portion being closed, the head protective plate is rotated in an opening direction and is separated from the surface portion of the thermal print head. On the other hand, it is described that when the thermal print head portion is opened for replacement of the gauze frame, the head protective plate is rotated in a closing direction to thereby protect the surface portion of the thermal print head, whereby damage on the thermal print head can be prevented.

PRIOR ART DOCUMENT

Patent Document

Patent Document 1: Japanese Patent Application Laid-Open Publication No. 10-138534

SUMMARY

Problems to be Solved by the Invention

Incidentally, in the thermal stencil making unit using the thermal print head described in Patent Document 1, since the head protective plate is rotated in the closing direction via the pair of thermal print head supporting members manually by the operator after the thermal print head portion is opened in replacement of the gauze frame as described above, the surface portion of the thermal print head can be protected by the head protective plate.

However, since the gauze frame is detachably fixed to the stencil making unit body, while the thermal print head is openably and closably mounted on the openable and closable thermal print head portion, the thermal print head is not disposed on a side where the gauze frame is set.

Accordingly, if an operator forgets an opening/closing operation of the head protective plate due to a human error, the surface portion of the thermal print head is damaged when the gauze frame is replaced in a state where the head protective plate remains opened. On the other hand, if the thermal print head portion is closed in a state where the head protective plate remains closed, there is generated a problem such as damages or the like of the thermal gauze or the platen roller.

The present invention has been made in view of the above problem, and an object of the present invention is to provide a thermal stencil making unit which can safely protect the thermal print head without causing a human error by disposing the thermal print head on a side where the gauze frame is set when protecting the thermal print head by the head-protecting member in setting of the gauze frame.

Means to Solve the Invention

A first invention is a thermal stencil making unit that makes a stencil of a perforated image on a thermal gauze by selectively heating and driving a plurality of heat elements in accordance with image information while moving a thermal print head having the plurality of heat elements relative to the thermal gauze tightly stretched in a gauze frame detachably set in a unit housing, the thermal stencil making unit including a head-protecting member that moves between a protection position where the thermal print head is protected and a protection release position where a protective state is released, while being urged to a side of the protection position via urging means, wherein the thermal stencil making unit:

moves the head-protecting member to the protection position by the urging means, when the gauze frame is not set in the unit housing; and moves the head-protecting member against the urging means from the protection position to the protection release position, in conjunction with an operation of setting the gauze frame in the unit housing.

In addition, a second invention is a thermal stencil making unit, wherein, in the thermal stencil making unit in the first invention described above:

the head-protecting member is a head-protecting cover that protects the plurality of heat elements at the protection position;

the head-protecting cover is integrally provided with a pressing member; and when the thermal print head and the head-protecting cover are provided in the unit housing and the gauze frame is set in the unit housing, the pressing member presses the head-protecting cover from the protection position toward the protection release position by one end portion of the gauze frame in a setting direction.

Furthermore, a third invention is a thermal stencil making unit, wherein, in the thermal stencil making unit in the second invention described above:

when a platen portion that supports a platen roller capable of being pressed on a side of the thermal print head via the thermal gauze is provided in the unit housing, capable of being opened and closed, the pressing member is provided at least on one end portion side of both end portion sides in a direction orthogonal to the setting direction of the gauze frame on the head-protecting cover.

Moreover, a fourth invention is a thermal stencil making unit, wherein, in the thermal stencil making unit in the second or third invention described above:

the head-protecting cover is provided with a head cleaning material on a surface facing the plurality of heat elements.

In addition, a fifth invention is a thermal stencil making unit, wherein, in the thermal stencil making unit in the first invention described above:

the head-protecting member is a head periphery-protecting cover that has an opening portion through which the plurality of heat elements advances and retreats and that protects the thermal print head at the protection position in a periphery of the plurality of heat elements on an advance direction side of the gauze frame; and wherein when the gauze frame is set in the unit housing, the gauze frame is pressed, while resisting an urging force of the urging means, against the head periphery-protecting cover having reached the protection position, and the head periphery-protecting cover is moved from the protection position to the protection release position.

Furthermore, a sixth invention is a thermal stencil making unit, wherein, in the thermal stencil making unit in the fifth invention described above:

the head periphery-protecting cover is rotatably provided between the protection position and the protection release position, and a cylindrical pipe for introducing setting of the gauze frame to an upstream side facing the setting direction of the gauze frame is mounted along a direction orthogonal to the setting direction of the gauze frame;

the plurality of heat elements is rotated by the urging force of the urging means to the protection position while facing an inside of the opening portion and waits for the setting of the gauze frame; and the plurality of heat elements is pushed in by the gauze frame while resisting the urging force of the urging means in the setting of the gauze frame and is rotated to the protection release position where the plurality of heat elements protrudes upward from the inside of the opening portion.

Moreover, a seventh invention is a thermal stencil making unit, wherein, in the thermal stencil making unit in the fifth invention described above:

the head periphery-protecting cover is movably provided in a vertical direction between the protection position and the protection release position;

the plurality of heat elements is moved by the urging force of the urging means to the protection position while facing the inside of the opening portion and waits for the setting of the gauze frame; and the plurality of heat elements is pushed in by the gauze frame while resisting the urging force of the urging means in the setting of the gauze frame and is moved to the protection release position where the plurality of heat elements protrudes upward from the inside of the opening portion.

In addition, an eighth invention is a thermal stencil making unit, in the thermal stencil making unit in any of the first to seventh invention described above, further includes:

a first detection sensor configured to detect that the gauze frame is set by the head-protecting member when the head-protecting member has moved from the protection position to the protection release position; and a second detection sensor configured to detect the presence or absence of the thermal gauze when the gauze frame is set in the unit housing.

BRIEF DESCRIPTION OF DRAWINGS

The invention will now be described with reference to the accompanying drawings wherein.

DETAILED DESCRIPTION

Embodiments for putting a thermal stencil making unit according to the present invention into practice will be described below in detail in the order of a first embodiment and a second embodiment by referring to FIGS. 1 to 25.

First Embodiment

Figure 1:
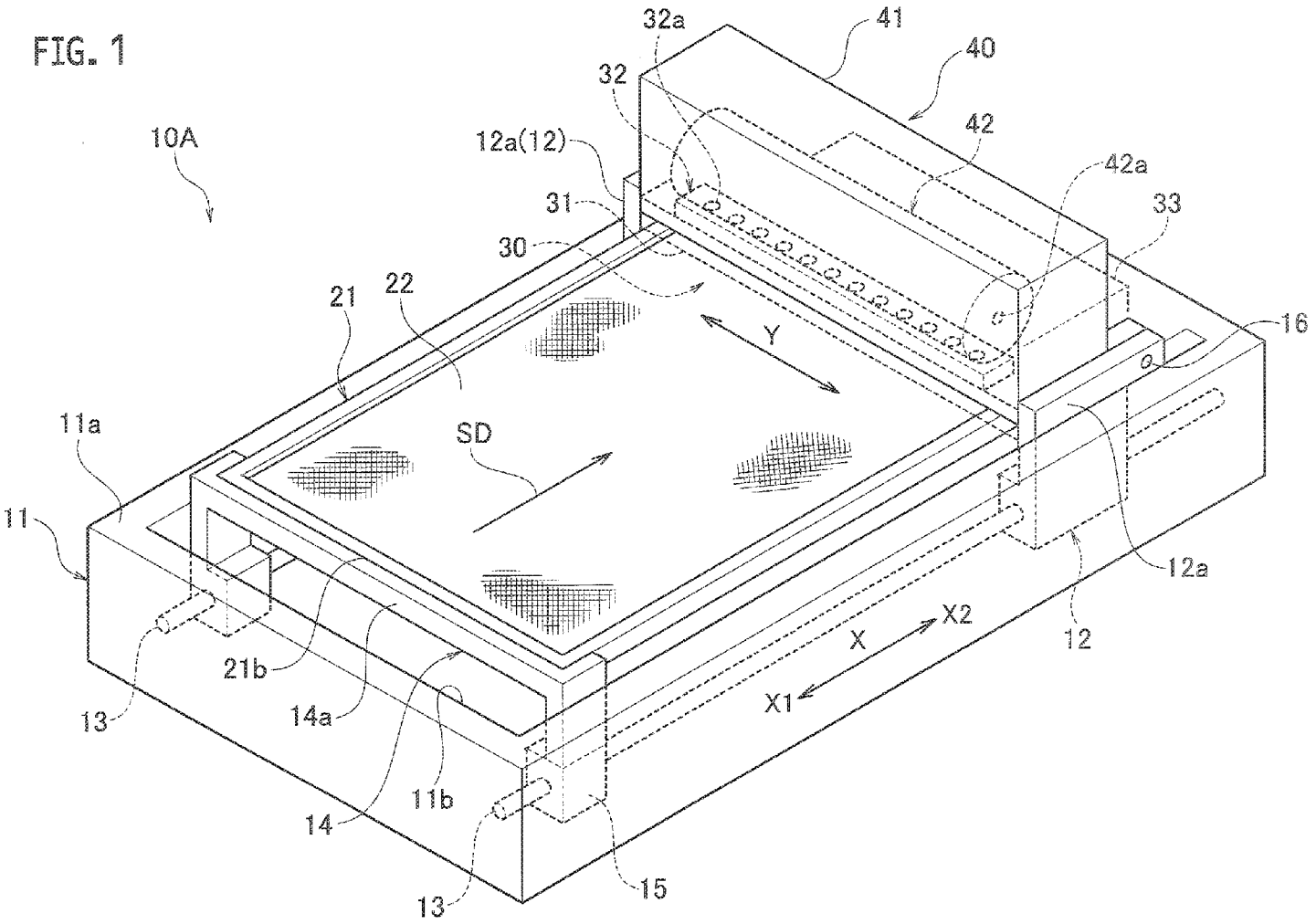
FIG. 1 is a perspective view illustrating a thermal stencil making unit according to a first embodiment of the present invention.

FIG. 1 perspectively illustrates a thermal stencil making unit according to a first embodiment of the present invention. In addition, FIG. 2 illustrates the thermal stencil making unit according to the first embodiment of the present invention seen from a side surface side, in a partial cross-section.

Figure 2:
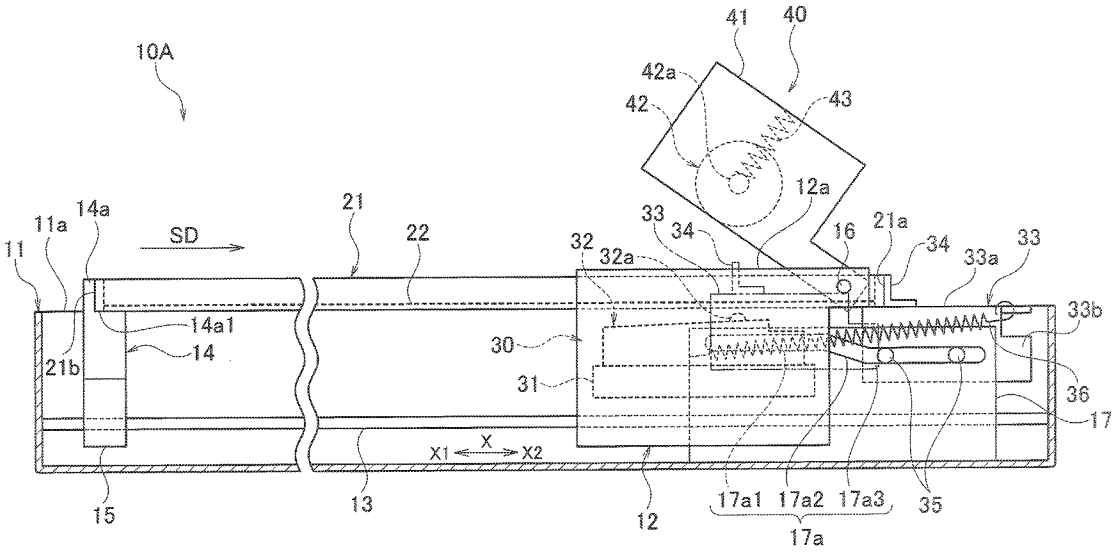
FIG. 2 is a side view illustrating the thermal stencil making unit according to the first embodiment of the present invention, in a partial cross-section.

As illustrated in FIGS. 1 and 2, in the thermal stencil making unit 10A according to the first embodiment of the present invention, a unit housing 11 is formed in a box shape.

An opening portion 11*b* (illustrated only in FIG. 1) is formed by being largely opened in a rectangular shape, on an upper surface 11*a* of the unit housing 11 described above. A gauze frame 21 formed in a rectangular shape is disposed above the opening portion 11*b* formed in the upper surface 11*a* of the unit housing 11 and at a substantially same position as that of the upper surface 11*a*.

At this time, the gauze frame 21 is mounted on a pressing/positioning member 34 on a head-protecting member 33 that will be described later and that is provided so as to be capable of reciprocating in an arrow X-direction and on a movable positioning member 14 movable in accordance with a length size of the gauze frame 21, in the opening portion 11*b* formed in the upper surface 11*a* of the unit housing 11. Note that, although the head-protecting member 33 moves, the pressing/positioning member 34 described above has a function of a fixed positioning member fixed and placed on this head-protecting member 33.

In addition, a thermal gauze 22 is tightly stretched on a lower part in the gauze frame 21, and this thermal gauze 22 is formed in a rectangular shape in a state where a heat-melting film is stuck with an adhesive agent onto a gauze having a plurality of meshes by weaving warps and woofs.

Furthermore, in the opening portion 11*b* formed in the upper surface 11*a* of the unit housing 11, a head portion 30 is placed so as to face the thermal gauze 22 below the thermal gauze 22 tightly stretched in the gauze frame 21.

The head portion 30 described above includes a head base 31 and a thermal print head 32 having a plurality of heat elements 32*a*. In addition, the thermal print head 32 in which the plurality of heat elements 32*a* is aligned in a Y-direction which is a main scanning direction is mounted on the head base 31 and attached so that the plurality of heat elements 32*a* comes into contact with the thermal gauze 22.

Moreover, the head base 31 on which the thermal print head 32 is mounted is mounted on a pair of right and left movable plates 12 and 12 reciprocating in an arrow X-direction while facing each other at intervals in the arrow Y-direction by sandwiching the gauze frame 21.

At this time, the pair of right and left movable plates 12 and 12 are provided in parallel with each other at intervals in the arrow Y-direction in the unit housing 11 and is movable along a pair of right and left guide shafts 13 and 13 provided lengthily along the arrow X-direction.

In addition, upper portions 12*a* and 12*a* of the pair of right and left movable plates 12 and 12 protrude upward from an inside of the opening portion 11*b* formed in the upper surface 11*a* of the unit housing 11.

Furthermore, in the unit housing 11, the head-protecting member 33 that protects this thermal print head 32 is provided facing the thermal print head 32, so as to be capable of reciprocating between a protection position P1 and a protection release position P2 where the protection state is released.

The head-protecting member 33 described above is a head-protecting cover that protects (covers) the plurality of heat elements 32*a* provided in the thermal print head 32 at the protection position P1 (covering position) and is provided so as to go away from the plurality of heat elements 32*a* at the protection release position P2 (covering release position).

Moreover, the head-protecting member 33 (hereinafter, referred to as a head-protecting cover) is movable from the protection position P1 to the protection release position P2 in conjunction with an operation of setting the gauze frame 21 to the unit housing 11 as will be described later.

Figure 3:
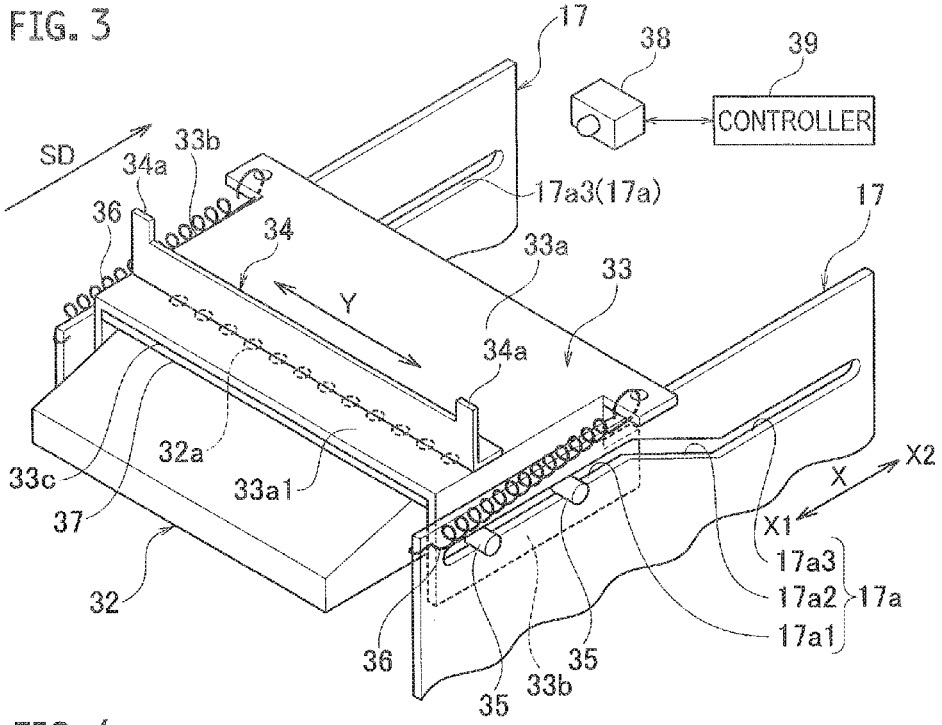
FIG. 3 is a perspective view illustrating a head-protecting cover and a pressing/positioning member mounted on an upper surface of this head-protecting cover, in the thermal stencil making unit according to the first embodiment of the present invention.
Figure 4:
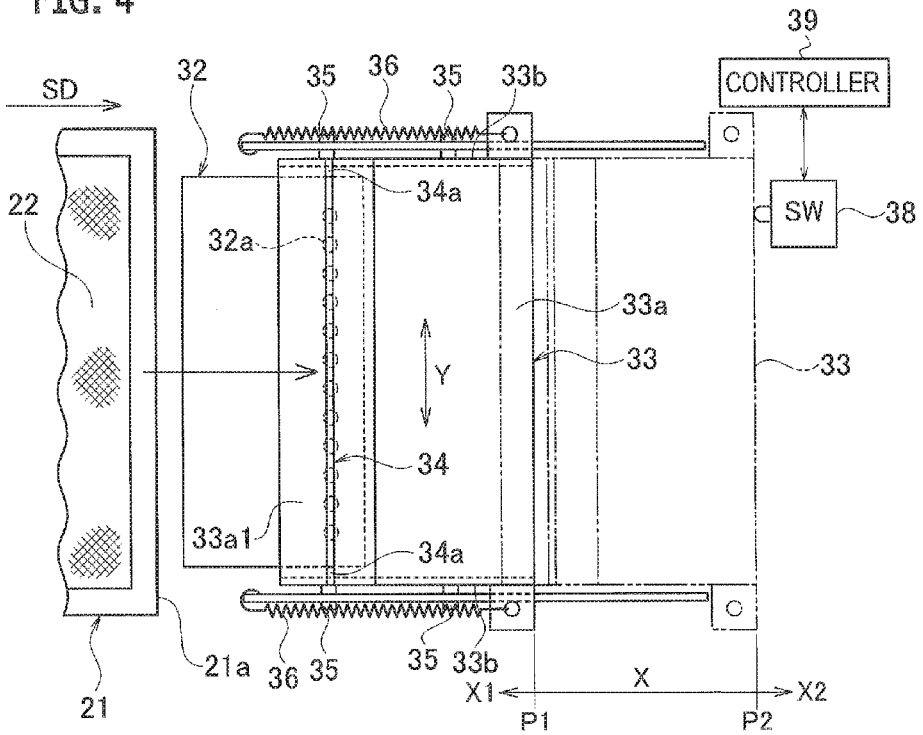
FIG. 4 is a plan view illustrating the thermal stencil making unit according to the first embodiment of the present invention.

Moreover, as illustrated in FIGS. 3 and 4, a gauze frame mounting portion 33*a*1 on which a front end portion 21*a* (one end portion) side of the gauze frame 21 in a setting direction SD is mounted is formed on an upper surface 33*a* of the head-protecting cover 33, on a front side facing the setting direction SD of the gauze frame 21. In addition, the pressing/positioning member 34 is placed upright on the upper surface 33*a* of the head-protecting cover 33 and at the rear of the gauze frame mounting portion 33*a*1 formed on the front side of this upper surface 33*a*.

The pressing/positioning member 34 described above has a function of positioning the front end portion 21*a* of the gauze frame 21 when the front end portion 21*a* of the gauze frame 21 is pressed approachably and separably and the gauze frame 21 is to be set in the unit housing 11.

At this time, when a platen portion 40 which will be described later is opened and the gauze frame 21 is not set in the unit housing 11, the head-protecting cover 33 has reached the protection position P1 (covering position) of a high height position indicated by a two-dot chain line in FIG. 2.

On the other hand, when an operator opens the platen portion 40 which will be described later to thereby set the gauze frame 21 in the unit housing 11, the front end portion 21*a* of the gauze frame 21 is pressed onto the pressing/positioning member 34, and thus the head-protecting cover 33 is pushed from the protection position P1 (covering position) described above to the lower protection release position P2 (covering release position) indicated by a solid line in FIG. 2.

The head-protecting cover 33 described above and the pressing/positioning member 34 mounted on the upper surface 33*a* of this head-protecting cover 33 constitute an essential part of this first embodiment and will be described later in detail.

Returning to FIGS. 1 and 2, in the unit housing 11, the movable positioning member 14 on which a rear end portion 21*b* (the other end portion) side of the gauze frame 21 opposite to the setting direction SD is mounted is provided movably back and forth in the arrow X-direction, when the gauze frame 21 is set on the upper surface 11*a* side of the unit housing 11. A U-shaped portion 14*a* is formed so as to follow a U-shape of a rear portion of the gauze frame 21, on an upper part of this movable positioning member 14.

In addition, there is formed, in the U-shaped portion 14*a* of the movable positioning member 14, a gauze frame mounting portion 14*al* on which the rear end portion 21*b* of the gauze frame 21 is mounted.

At this time, each of right and left end portions of the U-shaped portion 14*a* of the movable positioning member 14 is connected to a pair of right and left sliders 15 and 15 which advances from above into the opening portion 11*b* formed in the upper surface 11*a* of the unit housing 11 and is movable back and forth along the pair of right and left guide shafts 13 and 13.

The movable positioning member 14 retreats to the rear in the unit housing 11 when the gauze frame 21 is not set, whereas when the gauze frame 21 is set, the movable positioning member 14 moves to the front in accordance with the length size of the gauze frame 21 and causes the gauze frame mounting portion 14*al* formed on the U-shaped portion 14*a* to abut against the rear end portion 21*b* side of the gauze frame 21 while positioning, and allows the rear end portion 21*b* side of this gauze frame 21 to be mounted.

Accordingly, the movable positioning member 14 is fixed to a pair of right and left guide rails 17L and 17R by using a fixing means, not shown, at a position according to the length size of the gauze frame 21.

On the other hand, above the unit housing 11, the platen portion 40 is mounted capable of being opened and closed around a pair of right and left rotating shafts 16 and 16 on each of upper parts 12*a* and 12*a* of the pair of right and left movable plates 12 and 12 movable in the arrow X-direction.

The platen portion 40 described above includes, as illustrated in FIG. 2, a platen cover 41, a platen roller 42, and a compression spring 43 for pressing. In addition, in the platen cover 41 opened and closed around the rotating shaft 16, the platen roller 42 formed lengthily along the arrow Y-direction is rotatably provided via a platen roller driving source not shown. Furthermore, both end portion sides of a rotating shaft 42*a* of the platen roller 42 are pressed and urged toward the thermal print head 32 side in a lower position by the pair of right and left compression springs 43 and 43 for pressing.

Therefore, the thermal print head 32 provided in the head portion 30 and the platen roller 42 provided in the platen portion 40 are capable of integral movement in the arrow X-direction by facing each other via the pair of right and left movable plates 12 and 12.

When the thermal stencil making unit 10A is constituted as above, the plurality of heat elements 32*a* provided in the thermal print head 32 is brought into contact with the thermal gauze 22 tightly stretched in the gauze frame 21. Moreover, the platen roller 42 is pressed onto the thermal print head 32 side via the thermal gauze 22 by the compression springs 43 for pressing, from above the thermal gauze 22.

Then, while the thermal print head 32 and the platen roller 42 are moved in the arrow X1-direction that is a sub-scanning direction, the plurality of heat elements 32*a* aligned in the arrow Y-direction which is the main scanning direction is selectively heated and driven in accordance with the image information, whereby a stencil of a perforated image is made on the heat-melting film of the thermal gauze 22.

Here, there will be described, by the use of FIGS. 3 to 4, the head-protecting cover 33 and the pressing/positioning member 34 mounted on the upper surface 33*a* of this head-protecting cover 33 which serve as the essential part of this first embodiment.

FIG. 3 perspectively illustrates the head-protecting cover and the pressing/positioning member mounted on the upper surface of this head-protecting cover in the thermal stencil making unit according to the first embodiment of the present invention. In addition, FIG. 4 planarly illustrates the thermal stencil making unit according to the first embodiment of the present invention.

As illustrated in FIGS. 3 and 4, the head-protecting cover 33 has a pair of right and left side surfaces 33*b* and 33*b* formed by bending downward both end parts of the upper surface 33*a* in the arrow Y-direction by the use of a plate material.

In addition, two guide pins 35 and 35 are laterally provided, respectively, on outer sides of the pair of right and left side surfaces 33*b* and 33*b* formed on the head-protecting cover 33.

These two guide pins 35 and 35 are fitted into a pair of right and left guide grooves 17*a* and 17*a* formed in a pair of right and left frames 17 and 17 placed to face each other at intervals with the thermal print head 32 sandwiched in the unit housing 11.

At this time, in the guide grooves 17*a* formed in the frame 17, a first horizontal guide groove 17*al* whose height is great, an inclined guide groove 17*a*2, and a second horizontal guide groove 17*a*3 whose height is small are connected in a stepped form, from an upstream side toward a downstream side in the setting direction SD of the gauze frame 21.

In addition, each of one end portions of a pair of right and left tension springs 36 and 36 (urging means) urging this head-protecting cover 33 to the protection position P1 side (arrow X1-direction side) is hooked on the pair of right and left side surfaces 33*b* and 33*b* of the head-protecting cover 33, while each of the other end portions of the pair of right and left tension springs 36 and 36 is hooked to the pair of right and left frames 17 and 17.

Furthermore, at the rear of the gauze frame mounting portion 33*a*1 on the upper surface 33*a* of the head-protecting cover 33, the pressing/positioning member 34 described above by using FIG. 2 is fixed in a state of being formed in a plate shape with a predetermined height upward along a direction (arrow Y-direction) orthogonal to the setting direction SD of the gauze frame 21.

Moreover, in the pressing/positioning member 34, a pair of right and left protruding portions 34*a* and 34*a* are formed protrusively upward by a slight height, on both end portion sides of the direction (arrow Y-direction) orthogonal to the setting direction SD of the gauze frame 21.

In addition, when the head-protecting cover 33 has reached the protection position P1 in a state where the gauze frame 21 is not set and the platen cover 41 of the platen portion 40 is closed, the rotating shaft 42*a* of the platen roller 42 illustrated in FIG. 2 is lifted upward against the pair of right and left compression springs 43 and 43 for pressing, by the pair of right and left protruding portions 34*a* and 34*a* formed protrusively on the both end portion sides of the pressing/positioning member 34. Accordingly, the pressing/positioning member 34 does not damage the surface of the platen roller 42.

The pressing/positioning member 34 described above pushes the head-protecting cover 33 in an arrow X2-direction in conjunction with the setting operation of the gauze frame 21 as described above, and positions the front end portion 21*a* of this gauze frame 21 when the setting of the gauze frame 21 is completed.

Furthermore, a head cleaning material 37 using a felt or the like is fixed to a lower surface 33*c* of the head-protecting cover 33 facing the plurality of heat elements 32*a* provided in the thermal print head 32. This head cleaning material 37 can clean the plurality of heat elements 32*a* provided in the thermal print head 32 when the head-protecting cover 33 has reached the protection position P1, and thus a stencil of the perforated image can be favorably made on the thermal gauze 22.

Then, the head-protecting cover 33 is positioned at the protection position P1, when the head-protecting cover 33 has moved in the arrow X1-direction by the urging force of the tension spring 36 and has reached the first horizontal guide groove 17*al* whose height is great in the guide grooves 17*a*.

On the other hand, when the pressing/positioning member 34 on the head-protecting cover 33 has been pressed by this front end portion 21*a* in conjunction with the setting operation of the gauze frame 21, and thereby when the head-protecting cover 33 has moved while being pushed in the arrow X2-direction resisting the urging force of the tension spring 36 and has reached the second horizontal guide groove 17*a*3 whose height is small via the inclined guide groove 17*a*2 in the guide grooves 17*a*, the head-protecting cover 33 is located at the protection release position P2.

At this time, a controller 39 can detect that the head-protecting cover 33 has reached the protection release position P2, by pushing the micro switch 38 or the like by the head-protecting cover 33.

When the pressing/positioning member 34 is placed upright on the upper surface 33*a* of the head-protecting cover 33 as described above, an operation of the thermal stencil making unit 10A according to the first embodiment of the present invention will be described by the use of FIGS. 5A, 5B, and 5C.

Figure 5A:
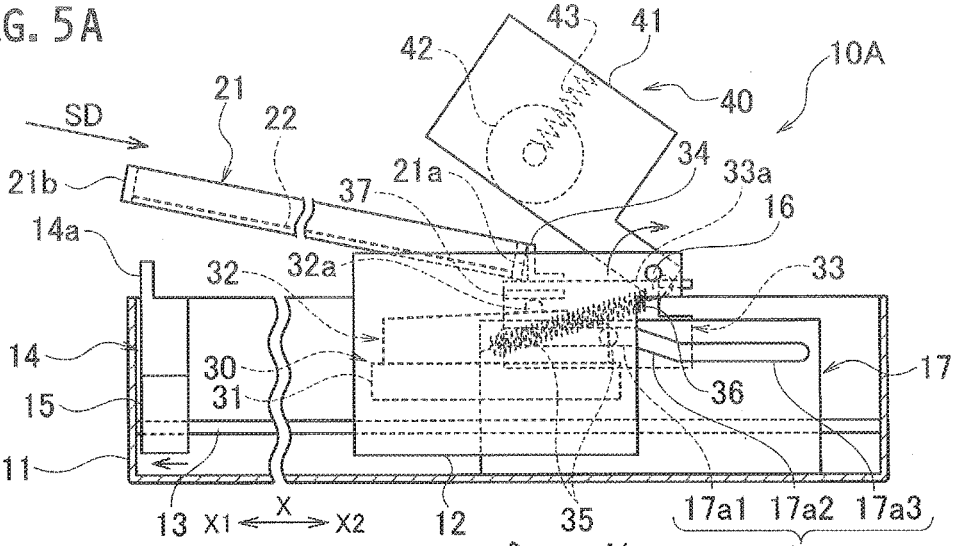
FIG. 5A is an operation diagram for explaining an operation of the thermal stencil making unit according to the first embodiment of the present invention and is a view illustrating a setting start state of a gauze frame.
Figure 5B:
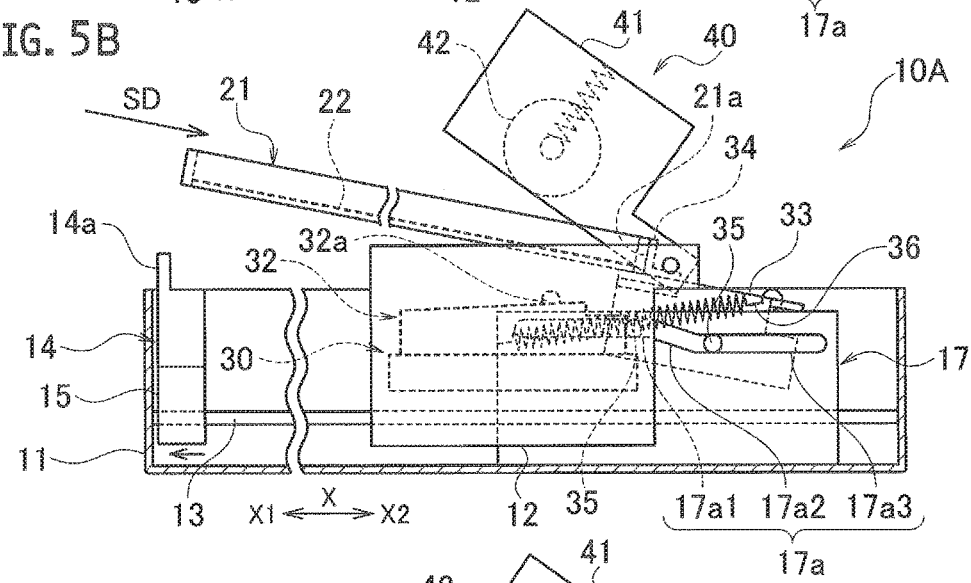
FIG. 5B is an operation diagram for explaining an operation of the thermal stencil making unit according to the first embodiment of the present invention and is a view illustrating a middle state of the setting of the gauze frame.
Figure 5C:
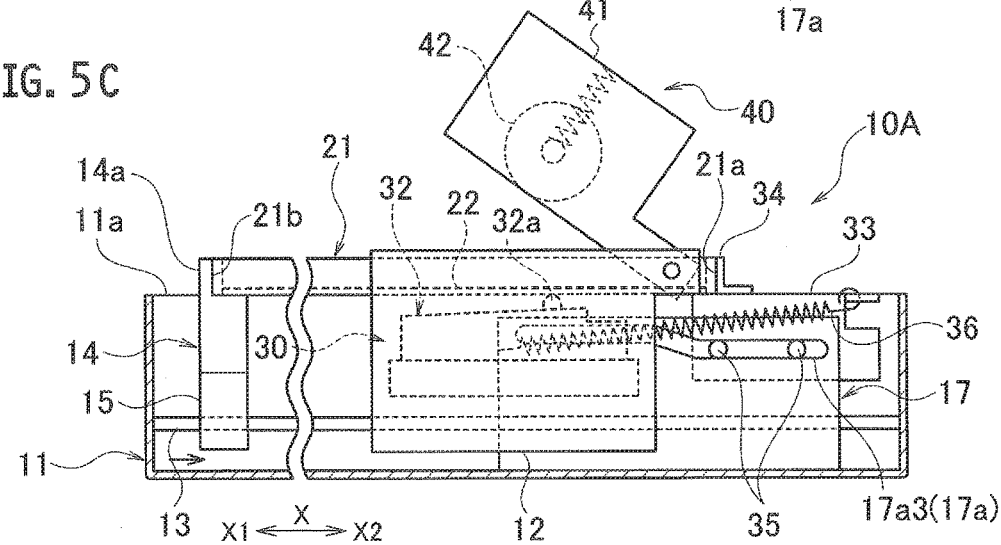
FIG. 5C is an operation diagram for explaining an operation of the thermal stencil making unit according to the first embodiment of the present invention and is a view illustrating a setting end state of a gauze frame.

FIGS. 5A, 5B, and 5C are operation diagrams for explaining the operation of the thermal stencil making unit according to the first embodiment of the present invention. FIG. 5A illustrates a setting start state of the gauze frame, FIG. 5B illustrates a middle state of the setting of the gauze frame, and FIG. 5C illustrates a setting end state of the gauze frame. Note that, in FIGS. 5A, 5B, and 5C, only a right side surface side of the unit is described in illustration, and description for a left side surface side symmetric to the right side surface side will be omitted.

First, as illustrated in FIG. 5A, in the thermal stencil making unit 10A according to the first embodiment of the present invention, when the operator starts setting of the gauze frame 21 in which the thermal gauze 22 is tightly stretched in the unit housing 11, the platen cover 41 of the platen portion 40 mounted on the movable plates 12 moving along the guide shafts 13 is rotated in a clockwise direction around the rotating shaft 16 and opened. Accordingly, the platen roller 42 provided in the platen cover 41 of the platen portion 40 is separated from the thermal print head 32 provided in the head portion 30.

On the other hand, the thermal print head 32 mounted on the movable plates 12 via the head base 31 is stopped at an initial position set on the right (arrow X2-direction side) in the unit housing 11.

In addition, in the head-protecting cover 33, the two guide pins 35 laterally provided on the side surface 33*b* of the head-protecting cover 33 are fitted by the urging force of the tension spring 36 into the first horizontal guide groove 17*al* whose height is great in the guide grooves 17*a* formed in the frame 17.

Accordingly, the head-protecting cover 33 has reached the protection position P1 (covering position) whose height is great in order to protect (cover) the plurality of heat elements 32*a* by facing the plurality of heat elements 32*a* provided in the thermal print head 32. At this time, the head cleaning material 37 mounted on the lower surface 33*c* of the head-protecting cover 33 is in contact with the plurality of heat elements 32*a*.

Then, when the head-protecting cover 33 has reached the protection position P1 in a state where the platen cover 41 of the platen portion 40 is closed, the rotating shaft 42*a* of the platen roller 42 is lifted upward by the pair of right and left protruding portions 34*a* and 34*a* formed protrusively on the both end portion sides of the pressing/positioning member 34 mounted on the upper surface 33*a* of the head-protecting cover 33, and thus no trouble is caused.

Therefore, when the gauze frame 21 is not set in the unit housing 11, the head-protecting cover 33 has been moved to the protection position P1. It is needless 15 to say that, when the gauze frame 21 is not set in the unit housing 11, the head-protecting cover 33 is automatically returned by the urging force of the tension spring 36 from the protection release position P2 to the protection position P1.

Moreover, the movable positioning member 14 obtained by forming, on the U-shaped portion 14*a*, the gauze frame mounting portion 14*a*1 on which the rear end portion 21*b* side of the gauze frame 21 is mounted and positioned retreats to the rear of the unit housing 11 (arrow X1-direction side) via the slider 15 moving along the guide shafts 13.

Here, when the operator starts the setting operation by directing the gauze frame 21 toward the setting direction SD of the gauze frame 21 with the front end portion 21*a* side of this gauze frame 21 at the head while grasping the gauze frame 21, the front end portion 21*a* side of the gauze frame 21 is mounted on the gauze frame mounting portion 33*a*1 formed on the upper surface 33*a* of the head-protecting cover 33, and at the same time, the front end portion 21*a* of the gauze frame 21 comes into contact with the pressing/positioning member 34 placed upright at the rear of the gauze frame mounting portion 33*al*.

After that, as illustrated in FIG. 5B, when the operator pushes the pressing/positioning member 34 toward the setting direction SD of the gauze frame 21 by the front end portion 21*a* of this gauze frame 21, the head-protecting cover 33 is pushed into the arrow X2-direction while resisting the urging force of the tension spring 36 and is separated from the protection position P1. At this time, the two guide pins 35 laterally provided on the side surface 33*b* of the head-protecting cover 33 goes from the first horizontal guide groove 17*al* whose height is great in the guide grooves 17*a* formed in the frame 17 toward the inclined guide groove 17*a*2.

Furthermore, after that, as illustrated in FIG. 5C, when the operator further pushes the pressing/positioning member 34 by the front end portion 21*a* of the gauze frame 21, the two guide pins 35 laterally provided on the side surface 33*b* of the head-protecting cover 33 are fitted into the second horizontal guide groove 17*a*3 whose height is small in the guide grooves 17*a* formed in the frame 17. Accordingly, since the head-protecting cover 33 reaches the protection release position P2 (covering release position) whose height is small, there can be prevented collision of this platen portion 40 against the head-protecting cover 33 when the platen portion 40 is closed.

Then, the pressing/positioning member 34 on the head-protecting cover 33 which has reached the protection release position P2 positions the front end portion 21*a* of the gauze frame 21.

After that, the operator moves the movable positioning member 14 to the front (arrow X2-direction side) of the unit housing 11 via the slider 15 moving along the guide shafts 13. In addition, the gauze frame mounting portion 14*a*1 formed on the U-shaped portion 14*a* of the movable positioning member 14 abuts while being positioned against the rear end portion 21*b* side of the gauze frame 21 and thus the rear end portion 21*b* side of this gauze frame 21 is mounted, and the setting operation of the gauze frame 21 in the unit housing 11 is completed. At this time, the plurality of heat elements 32*a* provided in the thermal print head 32 is in contact with the thermal gauze 22 tightly stretched in the gauze frame 21.

Then, after the setting operation of the gauze frame 21 is completed, although illustration here is omitted, the platen portion 40 is closed, and the thermal print head 32 and the platen roller 42 are moved integrally to the arrow X1-direction while the platen roller 42 is pressed toward the thermal print head 32 side via the thermal gauze 22 by 10 the urging force of the compression spring 43 for pressing, and a stencil of the perforated image is made on the thermal gauze 22 by the plurality of heat elements 32*a*.

The thermal stencil making unit 10A according to the first embodiment of the present invention described above in detail includes the head-protecting cover 33 moving while being urged to the protection position P1 side via the tension spring 36 between the protection position P1 where the plurality of heat elements 32*a* provided in the thermal print head 32 is protected and the protection release position P2 where the protection state is released; and the head-protecting cover 33 is moved from the protection position P1 to the protection release position P2 against the tension spring 36 in conjunction with the operation of setting the gauze frame 21 in the unit housing 11, while the head-protecting cover 33 is moved to the protection position P1 by the tension spring 36 when the gauze frame 21 is not set in the unit housing 11.

As a result, a human error caused by the operator does not occur in setting of the gauze frame 21, the plurality of heat elements 32*a* provided in the thermal print head 32 can be reliably protected by the head-protecting cover 33 that has reached the protection position P1, and the head-protecting cover 33 can be reliably moved from the protection position P1 to the protection release position P2 against the tension spring 36 in conjunction with the setting operation of the gauze frame 21. It is needless to say that, when the gauze frame 21 is not set in the unit housing 11, the head-protecting cover 33 can be automatically returned from the protection release position P2 to the protection position P1 by the tension spring 36.

At this time, when the gauze frame 21 is to be set in the unit housing 11, the pressing member 34 pressing the head-protecting cover 33 from the protection position P1 toward the protection release position P2 by the front end portion 21*a* (one end portion) of the gauze frame 21 is provided integrally on the head-protecting cover 33, and thus the thermal print head protection structure is simple, and the operator can easily move the head-protecting cover 33 from the protection position P1 to the protection release position P2.

First Modification of First Embodiment

Subsequently, a first modification obtained by partially modifying the thermal stencil making unit 10A according to the first embodiment of the present invention will be described by the use of FIGS. 6 and 7.

Figure 6:
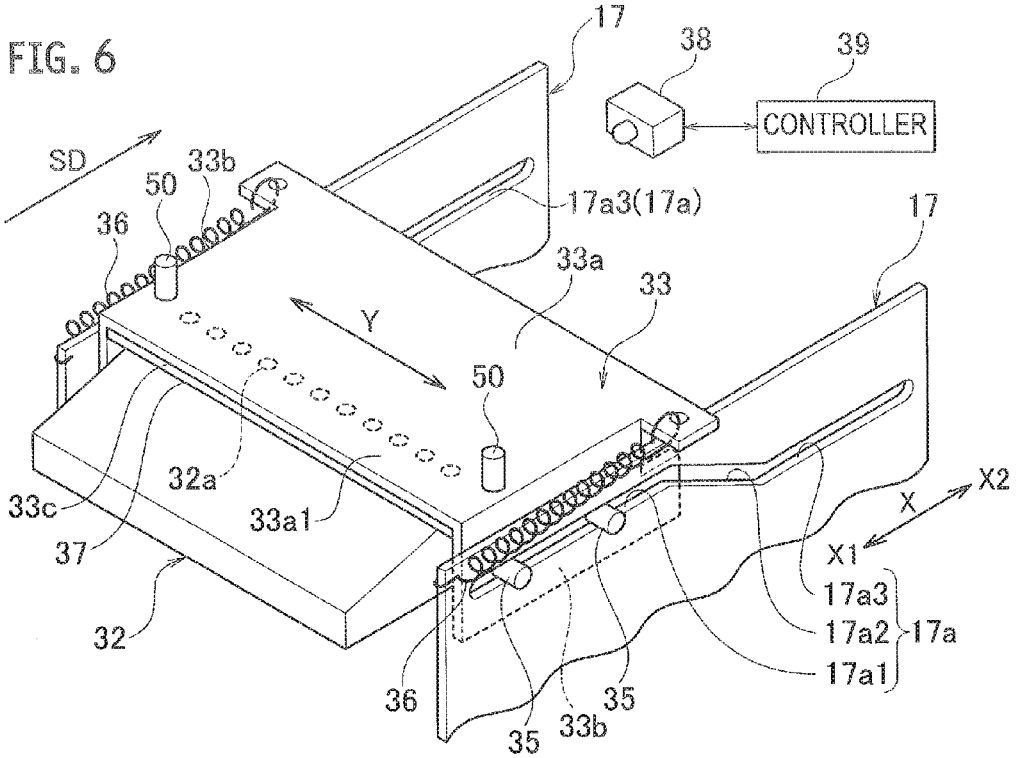
FIG. 6 is a perspective view illustrating a head-protecting cover and a pressing/positioning member mounted on an upper surface of this head-protecting cover, in a first modification obtained by partially modifying the thermal stencil making unit according to the first embodiment of the present invention.

FIG. 6 perspectively illustrates the head-protecting cover and the pressing/positioning member mounted on the upper surface of this head-protecting cover in the first modification obtained by partially modifying the thermal stencil making unit according to the first embodiment of the present invention. In addition, FIG. 7 planarly illustrates the first modification obtained by partially modifying the thermal stencil making unit according to the first embodiment of the present invention.

Figure 7:
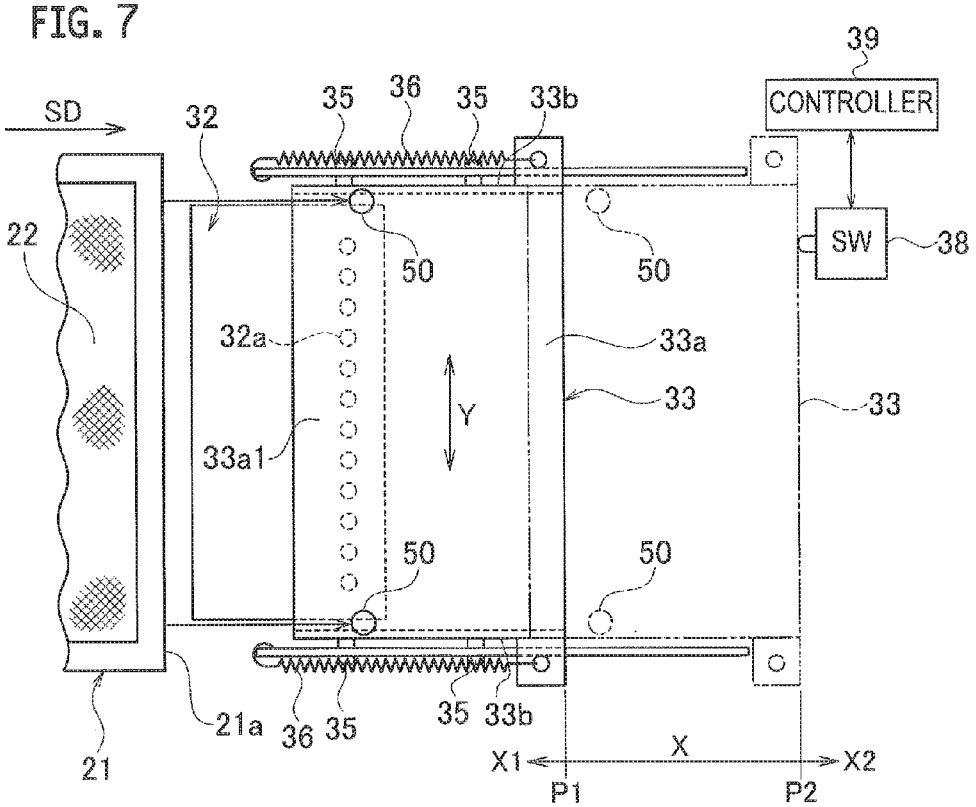
FIG. 7 is a plan view illustrating the first modification obtained by partially modifying the thermal stencil making unit according to the first embodiment of the present invention.

The first modification obtained by partially modifying the thermal stencil making unit according to the first embodiment of the present invention illustrated in FIGS. 6 and 7 is different from the first embodiment only in terms of two pressing/positioning members 50 and 50 mounted on the upper surface 33*a* of the head-protecting cover 33, and thus the same reference numerals are attached to the same constituent members as those in the first embodiment in illustration, and detailed description will be omitted, and points different from the first embodiment will be mainly described below.

Namely, as illustrated in FIGS. 6 and 7, in the first modification obtained by partially modifying the thermal stencil making unit according to the first embodiment of the present invention, instead of the pressing/positioning member 34 illustrated in FIGS. 3 and 4, the two pressing/positioning members 50 and 50 are provided upright on the upper surface 33*a* of the head-protecting cover 33 and also at the rear of the gauze frame mounting portion 33*al* formed on the front side of this upper surface 33*a*, and on both end portion sides of the direction (arrow Y-direction) orthogonal to the setting direction SD of the gauze frame 21, respectively.

The above-described two pressing/positioning members 50 and 50 are fixed in a state of being formed as rod-shaped members having predetermined heights upward from the upper surface 33*a* of the head-protecting cover 33.

Then, when the head-protecting cover 33 has reached the protection position P1 in a state where the platen cover 41 of the platen portion 40 is closed, the rotating shaft 42*a* of the platen roller 42 illustrated in FIG. 2 is lifted upward by the two pressing/positioning members 50 and 50 against the pair of right and left compression springs 43 and 43 for pressing. Accordingly, the pressing/positioning member 50 does not damage the surface of the platen roller 42.

Note that the pressing/positioning member 50 in the first modification only needs to be provided on at least one end portion side of the both end portion sides in the direction orthogonal to the setting direction SD of the gauze frame 21 on the upper surface 33*a* of the head-protecting cover 33.

As in the first embodiment, the above-described pressing/positioning members 50 also pushes the head-protecting cover 33 in the arrow X2-direction from the protection position P1 (covering position) to the protection release position P2 (covering release position) in conjunction with the setting operation of the gauze frame 21, and positions the front end portion 21*a* (one end portion) of this gauze frame 21 when the setting of the gauze frame 21 is completed.

Accordingly, in a state where the head-protecting cover 33 has reached the protection position P1 (covering position) where the plurality of heat elements 32*a* provided in the thermal print head 32 is protected (covered), when the operator erroneously closes the platen portion 40, a part of this platen portion 40 comes into contact with the two pressing/positioning members 50 and 50, and thus the platen roller 42 in the platen portion 40 or the thermal gauze 22 in the gauze frame 21 is not damaged, which can contribute to safety of the thermal stencil making unit 10A.

Second Modification of First Embodiment

Subsequently, a second modification obtained by partially modifying the thermal stencil making unit 10A according to the first embodiment of the present invention will be described by the use of FIGS. 8 and 9.

Figure 8:
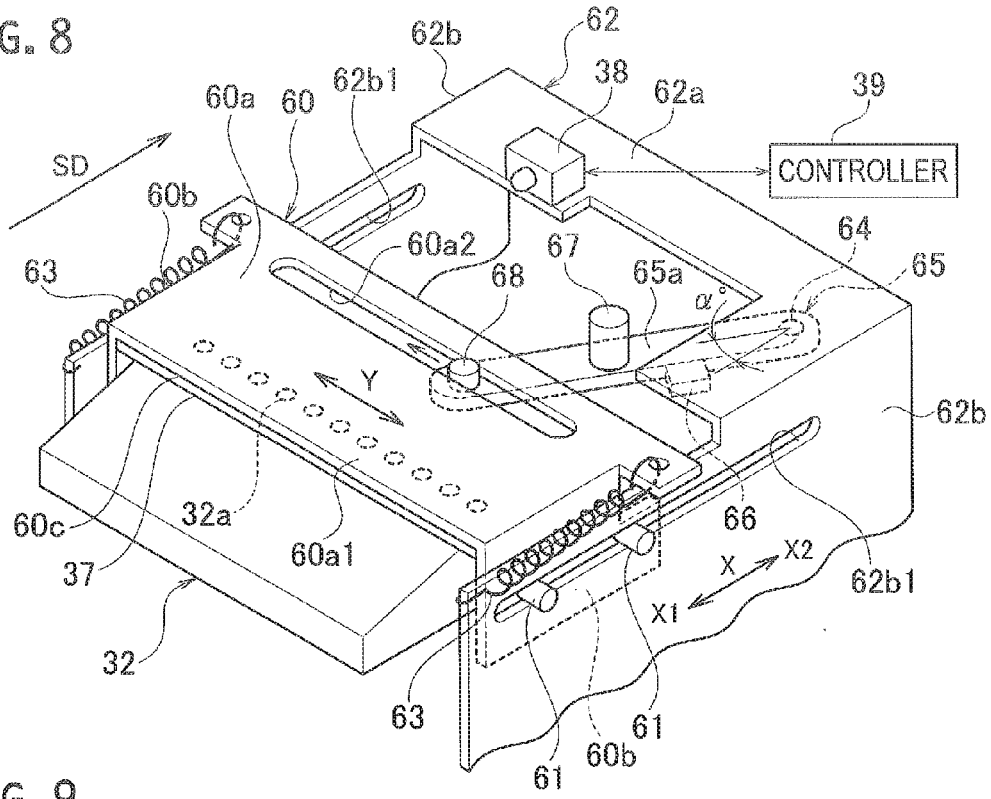
FIG. 8 is a perspective view illustrating the head-protecting cover and the pressing/positioning member mounted on an upper surface of a link arm, in a second modification obtained by partially modifying the thermal stencil making unit according to the first embodiment of the present invention.

FIG. 8 perspectively illustrates the head-protecting cover and the pressing/positioning member mounted on a link arm, in a second modification obtained by partially modifying the thermal stencil making unit according to the first embodiment of the present invention. In addition, FIG. 9 planarly illustrates the second modification obtained by partially modifying the thermal stencil making unit according to the first embodiment of the present invention.

In the second modification obtained by partially modifying the thermal stencil making unit according to the first embodiment of the present invention illustrated in FIGS. 8 and 9, only the head-protecting member 60 (hereinafter, referred to as a head-protecting cover) and a pressing/positioning member 67 mounted on the link arm 65 are different from those of the first embodiment, and thus the same reference numerals are attached to the same constituent members as those in the first embodiment in illustration, and detailed description will be omitted, and points different from the first embodiment will be mainly described below.

Figure 9:
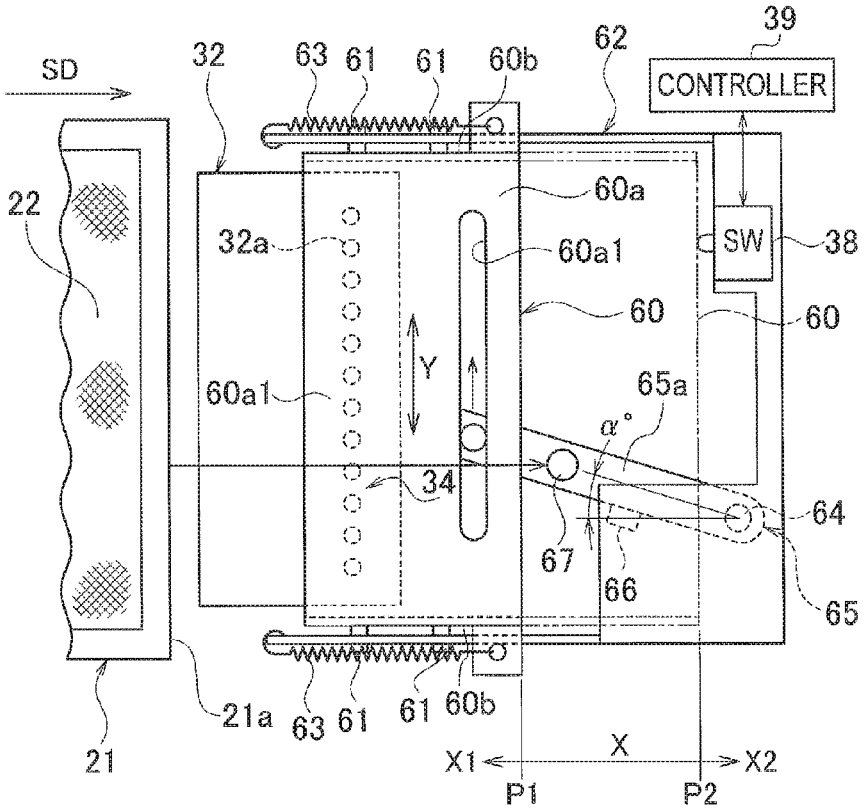
FIG. 9 is a plan view illustrating the second modification obtained by partially modifying the thermal stencil making unit according to the first embodiment of the present invention.

Namely, as illustrated in FIGS. 8 and 9, in the second modification obtained by partially modifying the thermal stencil making unit according to the first embodiment of the present invention, instead of the head-protecting cover 33 in the first embodiment, a head-protecting cover 60 opposable to the thermal print head 32 is movably provided between the protection position P1 (covering position) where the plurality of heat elements 32*a* is protected (covered) and the protection release position P2 (covering release position) where the protection state (covering state) is released.

This head-protecting cover 60 is also movable from the protection position P1 to the protection release position P2 in conjunction with the setting operation of the gauze frame 21 in the unit housing 11, as in the first embodiment.

The above-described head-protecting cover 60 is formed on the front side where a gauze frame mounting portion 60*al* on which the front end portion 21*a* side of the gauze frame 21 is mounted on this upper surface 60*a* faces the setting direction SD of the gauze frame 21.

In addition, at the rear of the gauze frame mounting portion 60*al* on the upper surface 60*a* of the head-protecting cover 60, a long hole 60*a*2 is penetratingly formed along the arrow Y-direction orthogonal to the setting direction SD of the gauze frame 21, and two guide pins 61 and 61 are laterally provided on outer sides of a pair of right and left side surfaces 60*b* and 60*b*, respectively.

These two guide pins 61 and 61 are fitted into a pair of right and left horizontal guide grooves 62*b*1 and 62*b*1 formed in a pair of right and left side surfaces 62*b* and 62*b* obtained by bending downward both end sides of an upper surface 62*a* in the arrow Y-direction, of an arm support body 62 placed in the unit housing 11.

Additionally, each of one end portions of a pair of right and left tension springs 63 and 63 that urge this head-protecting cover 60 to the protection position P1 side (arrow X1-direction side) is hooked to the pair of right and left side surfaces 60*b* and 60*b* of the head-protecting cover 60, whereas each of the other end portions of the pair of right and left tension springs 63 and 63 is hooked to the pair of right and left side surfaces 62*b* and 62*b* formed on the arm support body 62.

Furthermore, the head cleaning material 37 using a felt or the like is fixed onto the lower surface 60*c* of the head-protecting cover 60 facing the plurality of heat elements 32*a* provided in the thermal print head 32.

Moreover, one end portion side of the link arm 65 is rotatably supported by a rotating shaft 64 placed upright on a back side of the upper surface 62*a* of the arm support body 62 and on the side surface 62*b* side on a lower side in the illustration. This link arm 65 is mounted inclined by only a predetermined angle α toward an inner side with respect to the arrow X-direction by a stopper material 66 at the time of an initial state.

Moreover, the pressing/positioning member 67 is fixed to an intermediate portion on the upper surface 65*a* of the link arm 65, in a state of being formed as a rod-shaped member having a predetermined height upward.

As in the first embodiment, the pressing/positioning member 67 described above also pushes the head-protecting cover 60 into the arrow X2-direction from the protection position P1 toward the protection release position P2 in conjunction with the setting operation of the gauze frame 21, and positions the front end portion 21*a* of this gauze frame 21 when the setting of the gauze frame 21 is completed.

Moreover, an engagement pin 68 having a low height is fixed to the other end portion side on the upper surface 65*a* of the link arm 65, and this engagement pin 68 is fitted into the long hole 60*a*2 penetratingly formed in this upper surface 60*a* from the back surface side of the head-protecting cover 60.

In addition, when the head-protecting cover 60 is moving in the arrow X1-direction by the urging force of a tension spring 63, the head-protecting cover 60 is located at the protection position P1.

At this time, when the head-protecting cover 60 has reached the protection position P1 in a state where the platen cover 41 of the platen portion 40 is closed, the upper surface 60*a* of the head-protecting cover 60 is formed flat and thus, even if the upper surface 60*a* of the head-protecting cover 60 faces the platen roller 42, the surface of this platen roller 42 is not damaged.

On the other hand, when the pressing/positioning member 67 on the link arm 65 is pushed by this front end portion 21*a* in conjunction with the setting operation of the gauze frame 21, the link arm 65 is rotated in the clockwise direction around the rotating shaft 64.

Note that, when the pressing/positioning member 67 on the link arm 65 is pushed by the front end portion 21*a* of the gauze frame 21, since the link arm 65 is mounted inclined by only a predetermined angle α toward the inner side with respect to the arrow X-direction, the link arm 65 is deviated from a dead point direction in parallel with the arrow X-direction and can be easily rotated.

In addition, along with the rotation of the link arm 65, the engagement pin 68 on the link arm 65 moves toward the inner side in the long hole 60*a*2 formed in the upper surface 60*a* of the head-protecting cover 60, and thus the head-protecting cover 60 is pushed in the arrow X2-direction against the urging force of the tension spring 63 and is located at the protection release position P2.

At this time, the controller 39 can detect that the head-protecting cover 60 has reached the protection release position P2, by pushing the micro switch 38 or the like by the head-protecting cover 60.

Note that, in this second modification, since the pair of right and left horizontal guide grooves 62*b*1 and 62*b*1 formed in the pair of right and left side surfaces 62*b* and 62*b* of the arm support body 62 are linearly formed unlike the first embodiment, no trouble is caused in the head-protecting cover 60 even though the protection position P1 and the protection release position P2 have the same height.

Moreover, instead of the pair of right and left horizontal guide grooves 62*b*1 and 62*b*1 formed in the pair of right and left side surfaces 62*b* and 62*b* of the arm support body 62, a pair of right and left inclined guide grooves (not shown) whose height is gradually lowered from the protection position P1 toward the protection release position P2 can be provided.

Therefore, also in the second modification, as in the first embodiment, the head-protecting cover 60 moving between the protection position P1 where the plurality of heat elements 32*a* provided in the thermal print head 32 is protected and the protection release position P2 where the protection state is released is included, and the head-protecting cover 60 has been moved to the protection position P1 when the gauze frame 21 is not set in the unit housing 11, while the head-protecting cover 60 is moved from the protection position P1 to the protection release position P2 in conjunction with the operation of setting the gauze frame 21 in the unit housing 11.

As a result, a human error caused by the operator does not occur at the time of setting of the gauze frame 21, the plurality of heat elements 32*a* provided in the thermal print head 32 can be reliably protected by the head-protecting cover 60 which has reached the protection position P1, and the head-protecting cover 60 can be reliably moved from the protection position P1 to the protection release position P2 in conjunction with the setting operation of the gauze frame 21.

Note that, in the first embodiment (or the first and second modifications of the first embodiment) described above in detail, the example in which the front end portion 21*a* (one end portion) of the gauze frame 21 is mounted on the head-protecting cover 33 or 60, whereas the rear end portion

21*b* (the other end portion) of the gauze frame 21 is mounted on the U-shaped portion 14*a* of the movable positioning member 14 is described, but this is not limiting, and the gauze frame 21 can be mounted on the upper surface 11*a* of the unit housing 11.

Namely, when the gauze frame 21 is mounted on the upper surface 11*a* of the unit housing 11, although not shown here, a pair of right and left escape holes in which the pair of right and left movable plates 12 and 12 and the movable positioning member 14 can reciprocate are formed lengthily and at small widths along the arrow X-direction on right and left side surface sides in the upper surface 11*a* of the unit housing 11. Furthermore, an opening portion is largely opened in a rectangular shape in an upper surface portion of the gauze frame 21 facing the thermal gauze 22 tightly stretched in this gauze frame 21 excluding the portion of the gauze frame 21 between the pair of right and left escape holes formed in the upper surface 11*a* of the unit housing 11. Accordingly, the gauze frame 21 can be mounted on the upper surface 11*a* formed between the pair of right and left escape holes and the opening portion.

Second Embodiment

Figure 10:
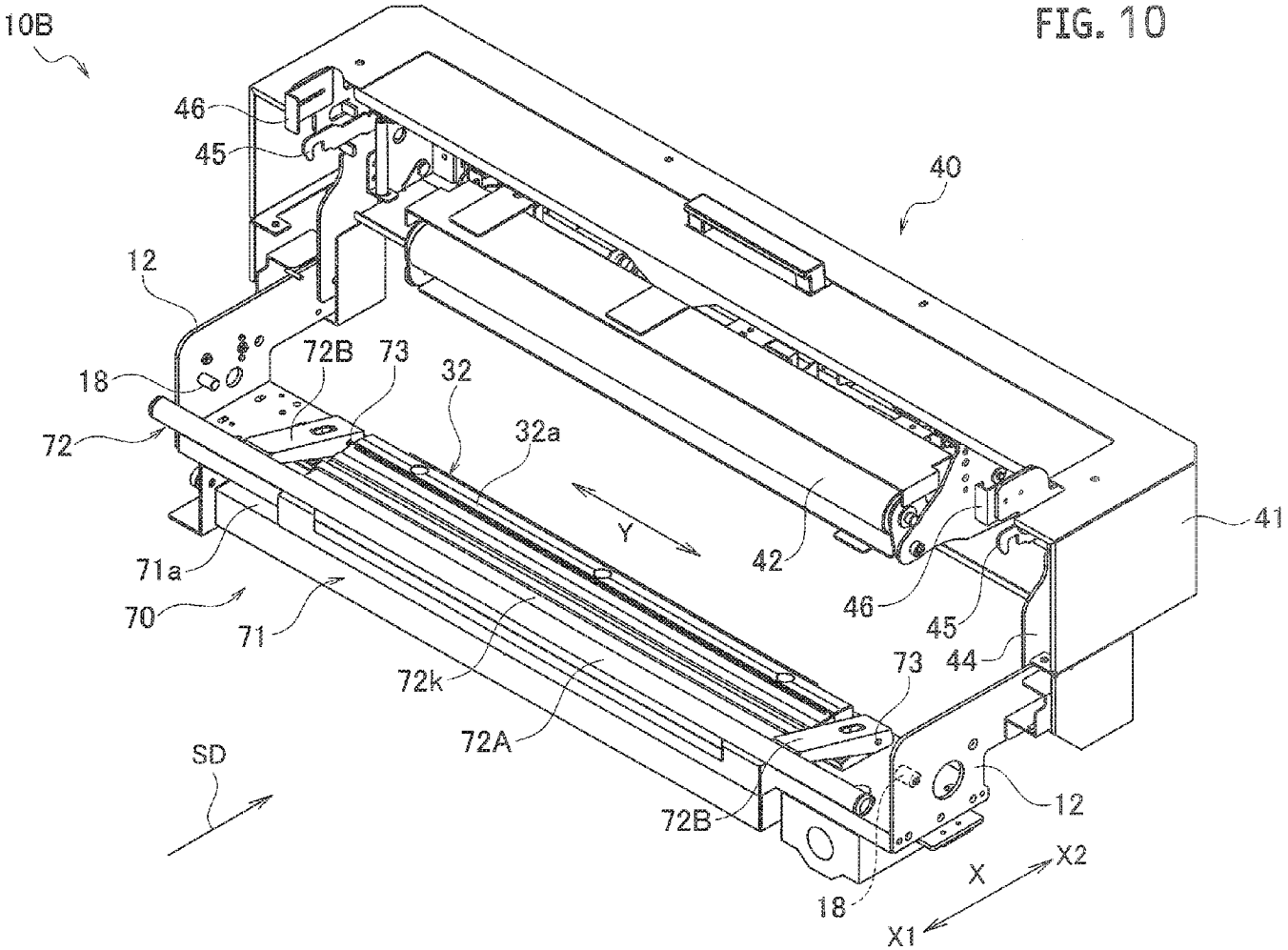
FIG. 10 is a perspective view illustrating a head portion and a platen portion in the thermal stencil making unit according to a second embodiment of the present invention.

FIG. 10 perspectively illustrates the head portion and the platen portion in the thermal stencil making unit according to a second embodiment of the present invention. In addition, FIGS. 11A and 11B illustrate the thermal stencil making unit according to the second embodiment of the present invention, with the head portion viewed from an upper surface and a side surface, respectively.

The thermal stencil making unit 10B according to the second embodiment of the present invention illustrated in FIG. 10 has a structure partially different from the thermal stencil making unit 10A according to the first embodiment of the present invention described previously by the use of FIGS. 1 and 2, and the same reference numerals are attached to the same constituent members as those in the first embodiment, and detailed description will be omitted, while new reference numerals are given to constituent members different from those in the first embodiment and thus different points will be mainly described below.

Figure 11A:
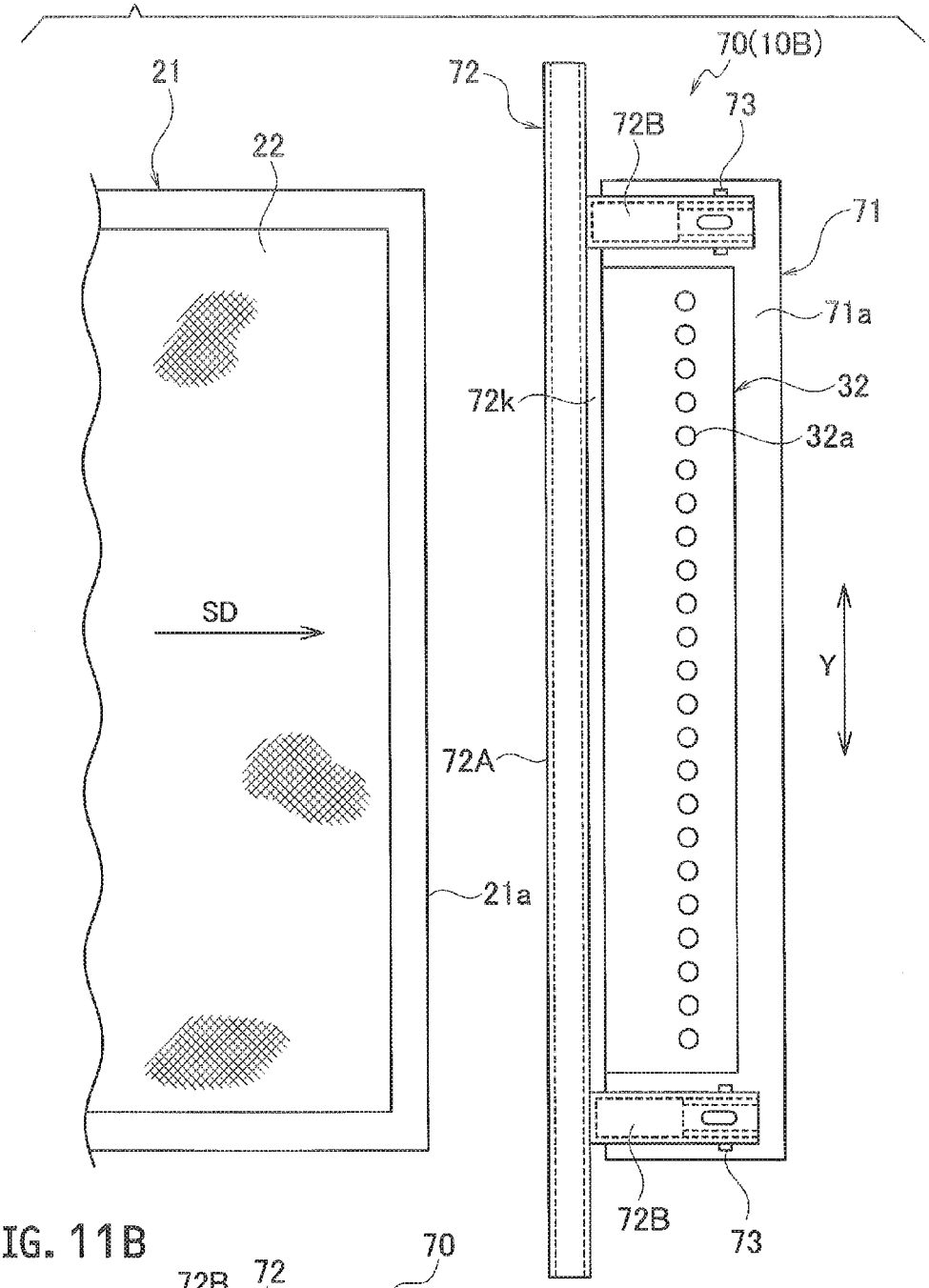
FIG. 11A is a top view illustrating the head portion in the thermal stencil making unit according to the second embodiment of the present invention.
Figure 11B:
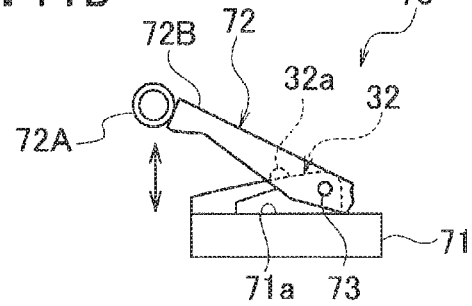
FIG. 11B is a side view illustrating the head portion in the thermal stencil making unit according to the second embodiment of the present invention.

As illustrated in FIGS. 10, 11A, and 11B, the thermal stencil making unit 10B according to the second embodiment of the present invention is different from that in the first embodiment, in terms of a head-protecting member 72 for protecting the thermal print head 32 mounted on an upper surface 71*a* of a head base 71 in a head portion 70.

In this second embodiment, the head-protecting member 72 is a head-periphery-protecting member that has an opening portion 72*k* through which the plurality of heat elements 32*a* provided in the thermal print head 32 advances and retreats and that protects the plurality of heat elements 32*a* at the protection position P1 where the thermal print head 32 is protected in a periphery on an advance direction side of the gauze frame 21. At this time, the periphery on the advance direction side of the gauze frame 21 is a periphery other than the opening portion 72*k* of the head periphery-protecting cover 72.

Then, when the head-protecting member 72 (hereinafter, referred to as a head periphery-protecting cover) has reached the protection position P1, unlike the first embodiment, the plurality of heat elements 32*a* provided in the thermal print head 32 can be visually recognized without being hidden by the opening portion 72*k* formed in the head periphery-protecting cover 72, and improvement is made such that the thermal print head 32 is protected when the gauze frame 21 is set, by protection (covering) of the periphery other than the plurality of heat elements 32*a* by the periphery other than the opening portion 72*k* of the head periphery-protecting cover 72.

The head periphery-protecting cover 72 described above is rotatably provided in a vertical direction (up-and-down direction) between the protection position P1 and the protection release position P2 around a pair of right and left rotating shafts 73 and 73 provided across the longitudinal direction (arrow Y-direction) of the thermal print head 32 and in the vicinity of right and left sides on one end side of the thermal print head 32 on the upper surface 71*a* of the head base 71.

Then, the head base 71 obtained by mounting the thermal print head 32 and the head periphery-protecting cover 72 is mounted on the pair of right and left movable plates 12 and 12 reciprocating in the arrow X-direction while facing each other at intervals in the arrow Y-direction which is the main scanning direction of the thermal print head 32, as in the first embodiment.

In addition, the platen portion 40 is mounted on an upper part of the pair of right and left movable plates 12 and 12, capable of being opened and closed, by facing the head portion 70, as in the first embodiment.

Figure 14:
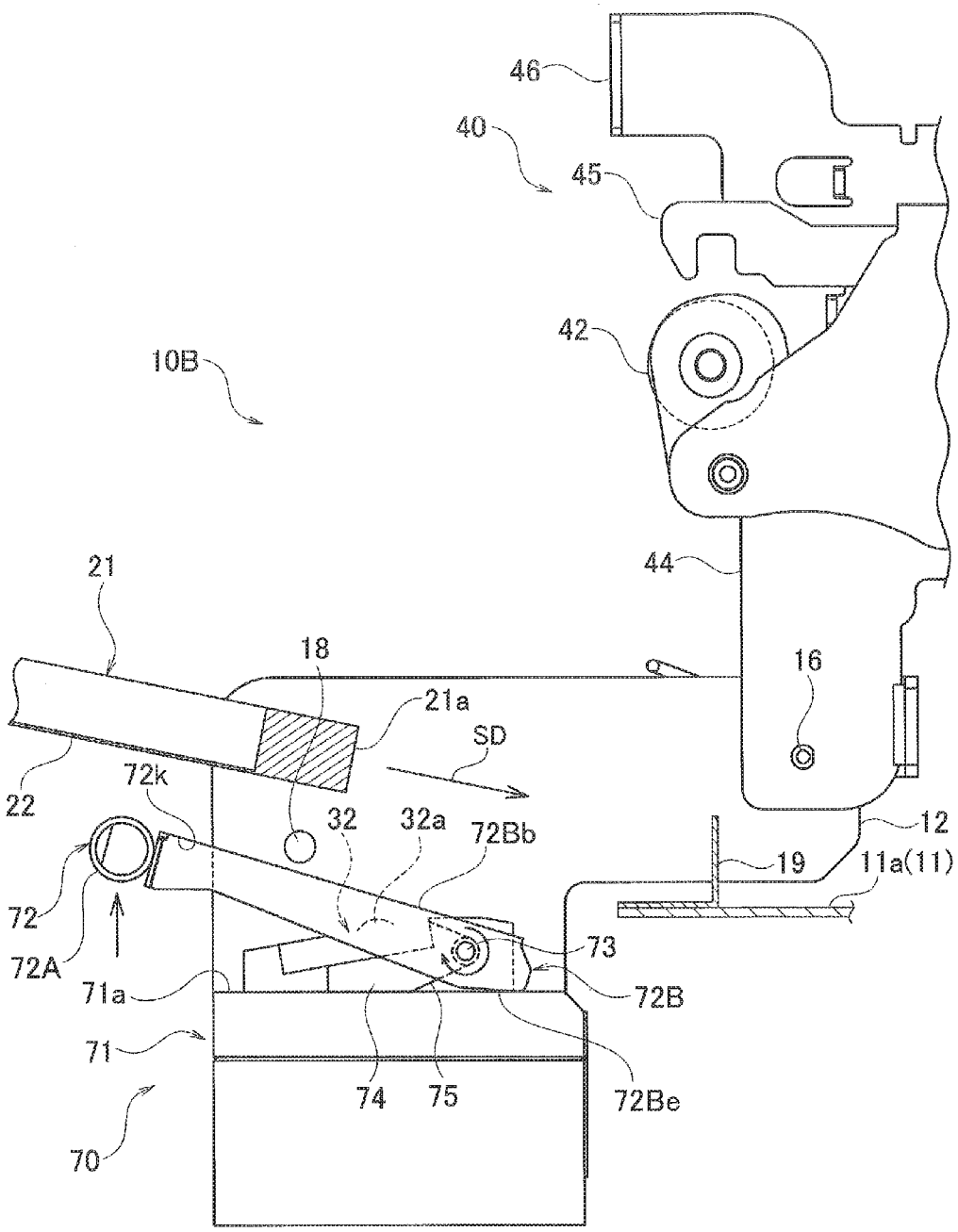
FIG. 14 is a first operation diagram illustrating an operation of the thermal stencil making unit according to the second embodiment of the present invention.
Figure 15:
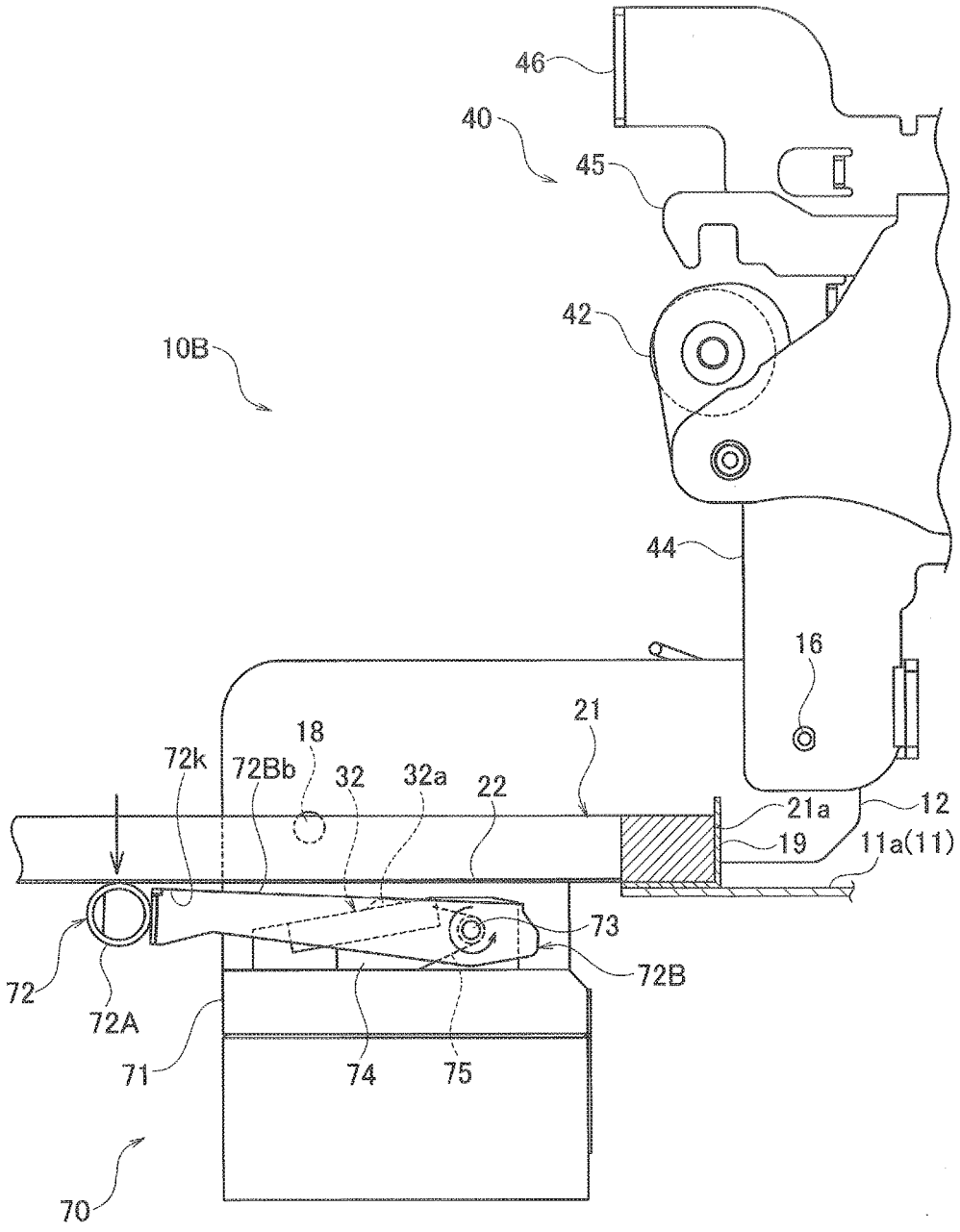
FIG. 15 is a second operation diagram illustrating the operation of the thermal stencil making unit according to the second embodiment of the present invention.
Figure 16:
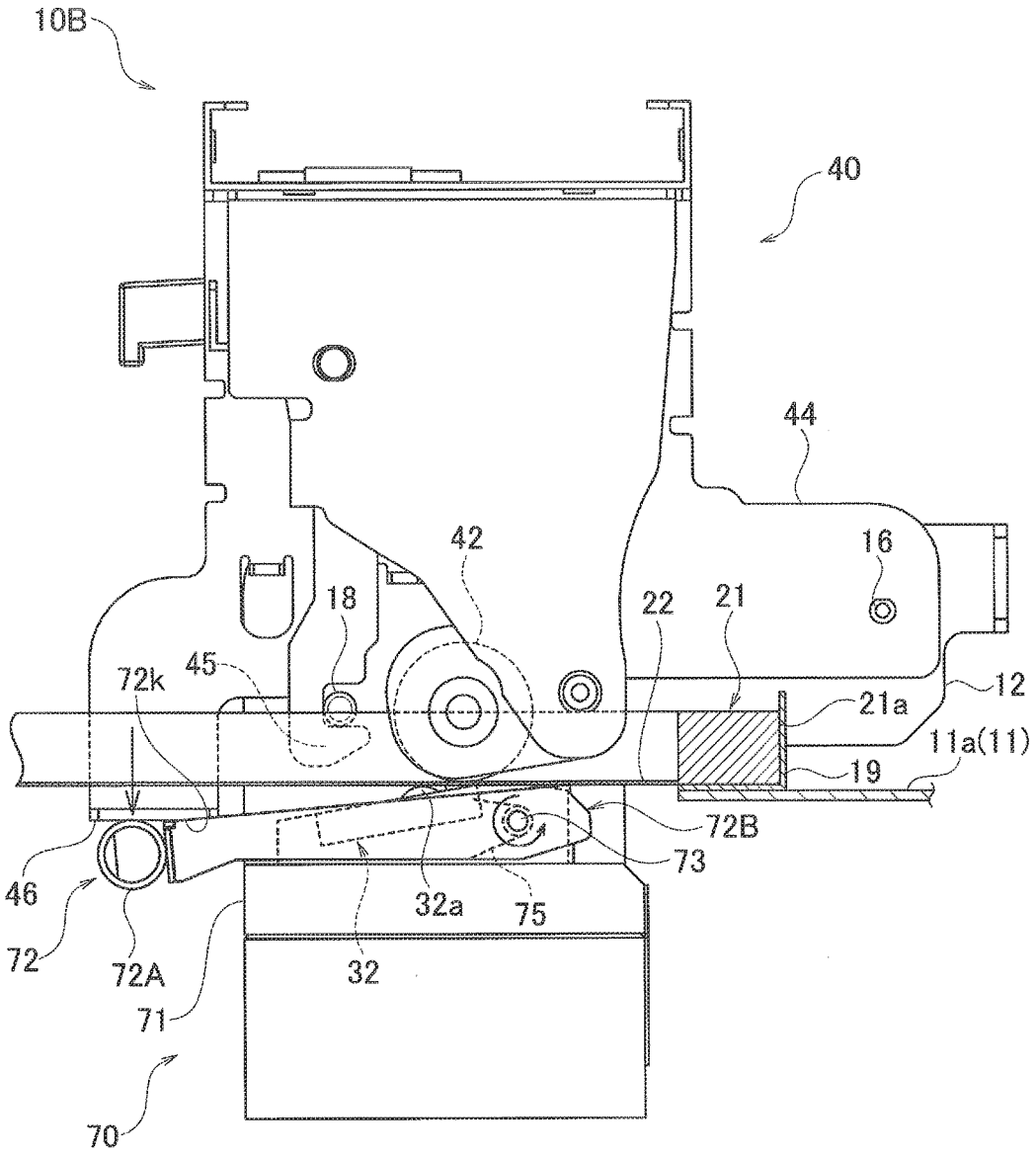
FIG. 16 is a third operation diagram illustrating the operation of the thermal stencil making unit according to the second embodiment of the present invention.

Additionally, a platen opening/closing frame 44 provided along the inner side of the platen cover 41 of the platen portion 40 is supported capable of being opened and closed integrally with the platen cover 41 around the rotating shaft 16 illustrated in FIGS. 14 to 16, in a state where the platen roller 42 is mounted.

Furthermore, in the platen opening/closing frame 44, a pair of right and left locking claws 45 and 45 are rotatably mounted in the vicinity of right and left ends in the longitudinal direction of the platen roller 42. The pair of these right and left locking claws 45 and 45 are locked to a pair of right and left locking pins 18 and 18 laterally provided on each of the inner sides of the pair of right and left movable plates 12 and 12 when the platen opening/closing frame 44 is closed.

Moreover, on the platen opening/closing frame 44, a pair of right and left pressing pieces 46 and 46 are mounted on each of outer sides of the pair of right and left 5 locking claws 45 and 45. The pair of these right and left pressing pieces 46 and 46 are constituted to press the head periphery-protecting cover 72 downward when the platen opening/closing frame 44 is closed, which will be described later by the use of FIG. 16.

Here, the head periphery-protecting cover 72 serving as an essential part of the second embodiment will be described by the use of FIGS. 12A, 12B, 13A, 13B, 13C, and 13D.

Figures 12A, 12B:
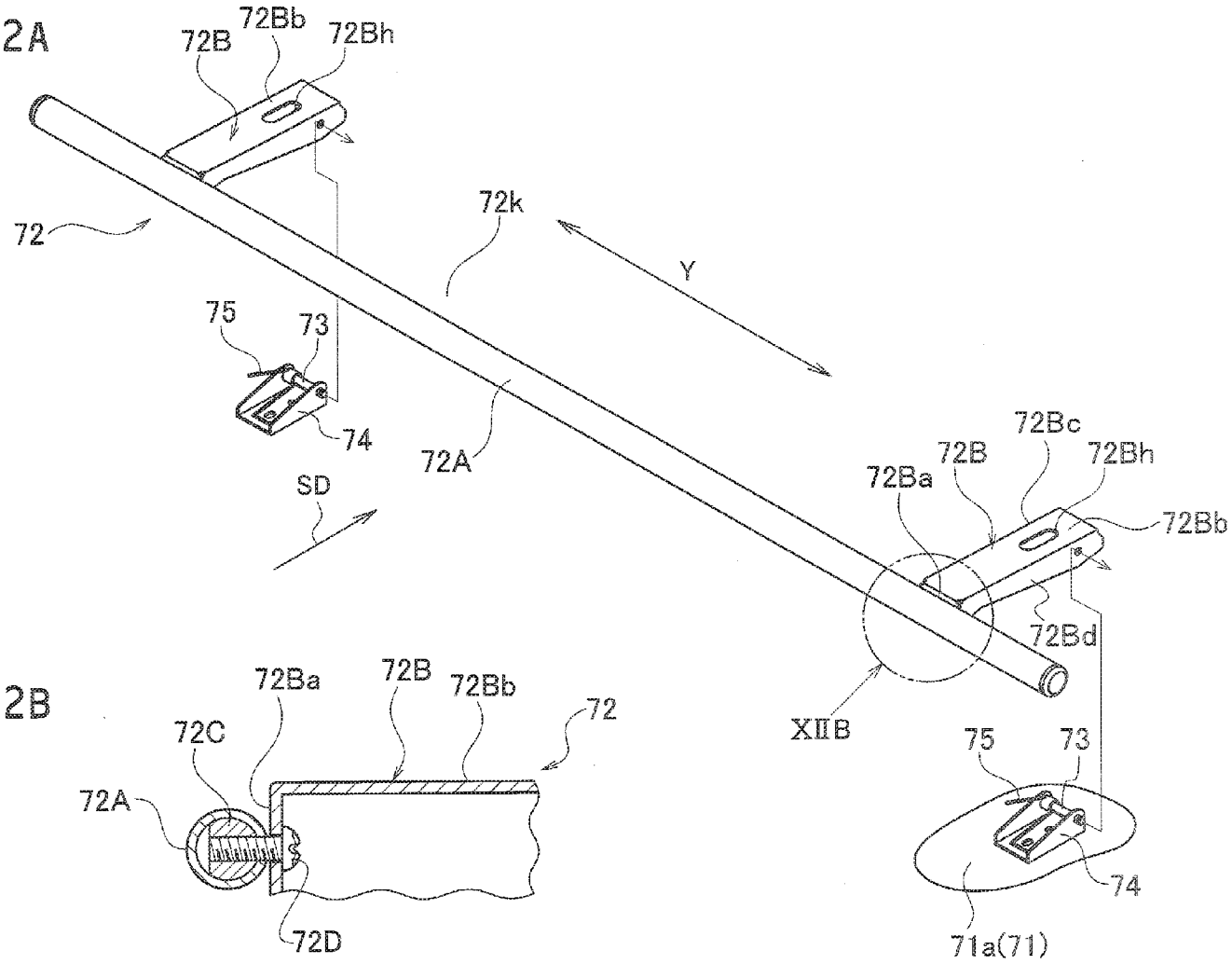
FIG. 12A is a view perspectively illustrating a head periphery-protecting cover and a pair of right and left brackets in an exploded manner, in the thermal stencil making unit according to the second embodiment of the present invention.
FIG. 12B is a partially cross-sectional view of a spot of an arm member of the head periphery-protecting cover illustrated in FIG. 12A.
Figures 13A, 13B, 13C, 13D:
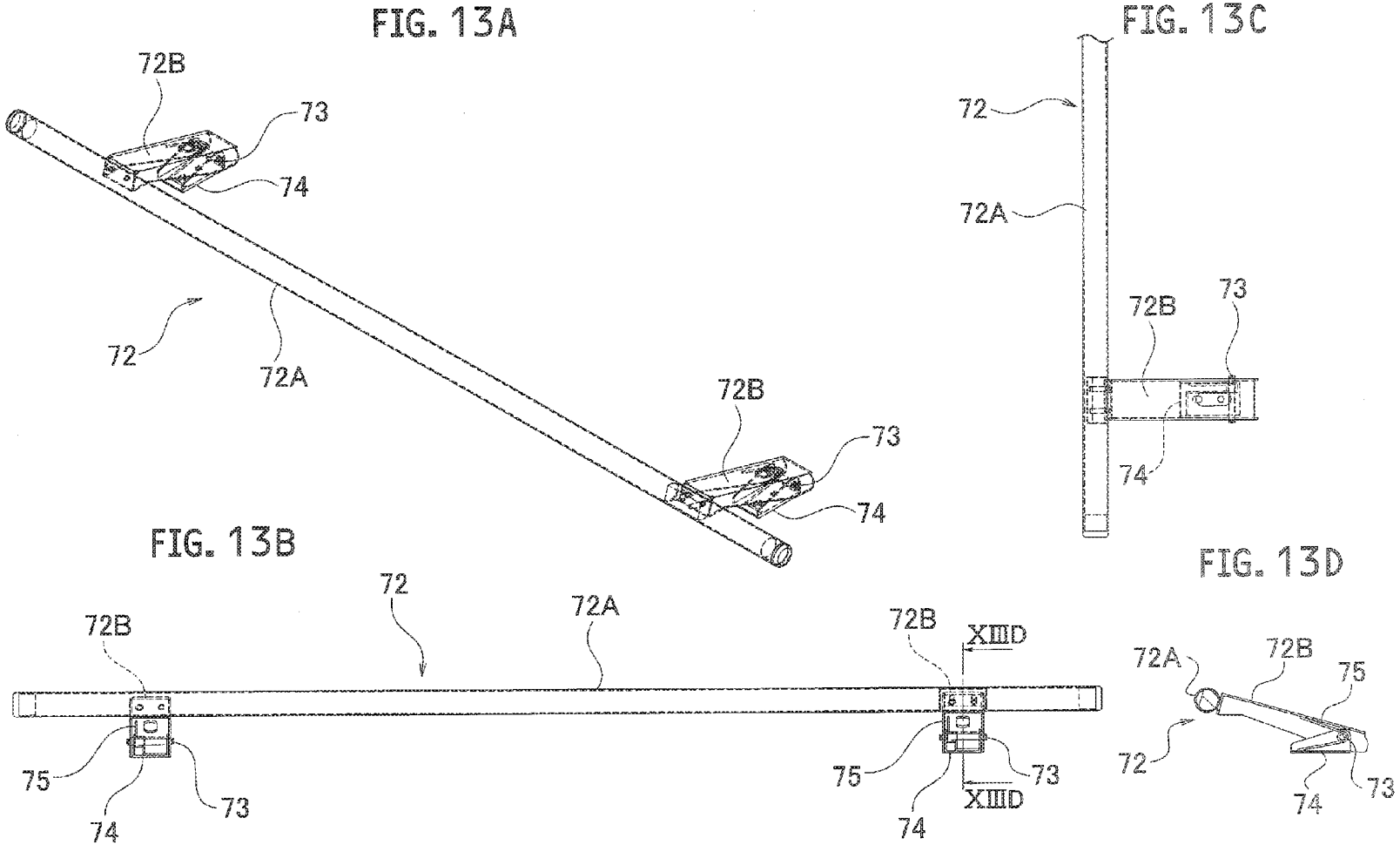
FIG. 13A is a perspective view illustrating a state where the head periphery protective cover is rotatably supported by the pair of right and left brackets in the thermal stencil making unit according to the second embodiment of the present invention.
FIG. 13B is a front view illustrating a state where the head periphery-protecting cover is rotatably supported by the pair of right and left brackets in the thermal stencil making unit according to the second embodiment of the present invention.
FIG. 13C is a side view illustrating a state where the head periphery-protecting cover is rotatably supported by the pair of right and left brackets in the thermal stencil making unit according to the second embodiment of the present invention.
FIG. 13D is an XIIID-XIIID line cross-sectional view illustrating a state where the head periphery-protecting cover is rotatably supported by the pair of right and left brackets in the thermal stencil making unit according to the second embodiment of the present invention.

FIG. 12A is a view perspectively illustrating the head periphery-protecting cover and a pair of right and left brackets in an exploded manner in the thermal stencil making unit according to the second embodiment of the present invention. FIG. 12B is a partially cross-sectional view of a position of an arm member of the head periphery-protecting cover illustrated in FIG. 12A. In addition, FIGS. 13A, 13B, 13C, and 13D illustrate states where the head periphery-protecting cover is rotatably supported by the pair of right and left brackets, and FIGS. 13A, 13B, 13C, and 13D are a perspective view, a front view, a side view, and an XIIID-XIIID line cross-sectional view, respectively, in the thermal stencil making unit according to the second embodiment of the present invention.

As illustrated in FIG. 12A, the head periphery-protecting cover 72 (head-protecting member) serving as the essential part of the second embodiment is integrally formed by a cylindrical pipe 72A formed lengthily along the arrow Y-direction that is the main scanning direction of the thermal print head 32 and a pair of right and left arm members 72B and 72B fastened on slightly inner sides from right and left end portions of this cylindrical pipe 72A.

In the head periphery-protecting cover 72 described above, the cylindrical pipe 72A for guiding setting of the gauze frame 21 to an upstream side facing the setting direction SD of the gauze frame 21 is mounted along a direction orthogonal to the setting direction SD of the gauze frame 21, and a downstream side of the setting direction SD of the gauze frame from the cylindrical pipe 72A is pivotally supported rotatably via the pair of right and left rotating shafts 73 and 73.

Furthermore, the opening portion 72*k* facing the plurality of heat elements 32*a* provided in the thermal print head 32 is opened largely in an inner side surrounded by the cylindrical pipe 72A and the pair of right and left arm members 72B and 72B.

At this time, the cylindrical pipe 72A described above is formed to be lightweight by the use of, for example, a stainless pipe having rigidity and abrasion resistance. In addition, as will be described later, when the gauze frame 21 is to be set from the setting direction SD in a state where the head periphery-protecting cover 72 has risen to the protection position P1, the setting of the gauze frame 21 is guided by the cylindrical pipe 72A so that the setting can be smoothly carried out without the front end portion 21*a* of the gauze frame 21 being hooked by the head periphery-protecting cover 72.

On the other hand, the arm member 72B described above is formed by downward bending of a front surface 72Ba directed to the setting direction SD of the gauze frame 21 and right and left side surfaces 72Bc and 72Bd consecutively connected to right and left of an upper surface 72Bb, by the use of a sheet metal material.

In addition, as illustrated in FIG. 12B, when the head periphery-protecting cover 72 is formed, a female screw member 72C is fitted into the cylindrical pipe 72A, and subsequently this cylindrical pipe 72A is brought into contact with the front surface 72Ba of the arm member 72B and fastened by a male screw 72D from a back surface side of the front surface 72Ba of this arm member 72B.

Returning to FIG. 12A, a pair of right and left brackets 74 and 74 are prepared by facing the arm members 72B, respectively, below each of the pair of right and left arm members 72B and 72B of the head periphery-protecting cover 72.

The pair of these right and left brackets 74 and 74 are formed by bending of a sheet metal material into an upward U-shape.

In addition, after each of the brackets 74 is fitted in an inner side between the right and left side surfaces 72Bc and 72Bd on a rear side opposite to the front surface 72Ba of each of the arm members 72B, each of the arm members 72B and each of the brackets 74 are rotatably connected via each of the rotating shafts 73.

Furthermore, when each of the arm members 72B and each of the brackets 74 are to be connected, each of torsion springs 75 is fitted into each of the rotating shafts 73, and an urging force of each of the torsion springs 75 urges the head periphery-protecting cover 72 upward via each of the rotating shafts 73.

Moreover, an escape hole 72Bh through which a screw, not shown, for mounting each of the brackets 74 on the upper surface 71*a* of the head base 71 is inserted is penetratingly formed in the upper surface 72Bb of each of the arm members 72B.

Therefore, the states illustrated in FIGS. 13A, 13B, 13C, and 13D are obtained when the head periphery-protecting cover 72 is supported by the pair of right and left brackets 74 and 74 via the pair of right and left rotating shafts 73 and 73.

After the head periphery-protecting cover 72 is supported by the pair of right and left brackets 74 and 74 via the pair of right and left rotating shafts 73 and 73, the pair of right and left brackets 74 and 74 are mounted onto the upper surface 71*a* of the head base 71.

Here, there will be described, by the use of FIGS. 14 to 16, an operation of the thermal stencil making unit 10B according to the second embodiment of the present invention when the head periphery-protecting cover 72 is rotatably supported on the head base 71 across the longitudinal direction of the thermal print head 32, as described above.

FIGS. 14 to 16 schematically illustrate first to third operations for describing the operation of the thermal stencil making unit according to the second embodiment of the present invention.

Note that, in FIGS. 14 to 16, only a right side surface side of the unit is described in illustration, and description for a left side surface side symmetric to the right side surface side will be omitted.

Furthermore, in FIGS. 14 to 16, on a front of the head portion 70 in the second embodiment, unlike the first embodiment, a positioning member 19 for causing the front end portion 21*a* side of the gauze frame 21 to abut while positioning and mounting it is assumed to be fixed and placed on the upper surface 11*a* of the unit housing 11.

First, in the first operation in the second embodiment illustrated in FIG. 14, the platen opening/closing frame 44 in the platen portion 40 is in an open state around the rotating shaft 16. In this state, the head periphery-protecting cover 72 mounted, via the bracket 74, on the upper surface 71*a* of the head base 71 provided in the head portion 70 via the bracket 74 is raised while rotating in the clockwise direction around the rotating shaft 73 by the urging force of the torsion spring 75 fitted into the rotating shaft 73, and has reached the protection position P1 where the thermal print head 32 is protected.

At this time, since a rear-end lower surface 72Be of the arm member 72B of the head periphery-protecting cover 72 comes into contact on the upper surface 71*a* of the head base 71, the height of the head periphery-protecting cover 72 at the protection position P1 is regulated.

Then, when the head periphery-protecting cover 72 has reached the protection position P1, the operator starts the setting operation by directing the gauze frame 21 toward the setting direction SD of the gauze frame 21 with the front end portion 21*a* side of this gauze frame 21 at the head while grasping the gauze frame 21 in which the thermal gauze 22 is tightly stretched, from above the head periphery-protecting cover 72.

At this time, since the cylindrical pipe 72A of the head periphery-protecting cover 72 is directed to the setting direction SD of the gauze frame 21 and guides the setting of the gauze frame 21, the setting operation can be smoothly carried out even if the front end portion 21*a* of the gauze frame 21 comes into contact with the cylindrical pipe 72A of the head periphery-protecting cover 72.

In addition, when the head periphery-protecting cover 72 has reached the protection position P1, the plurality of heat elements 32*a* provided in the thermal print head 32 faces the inside of the opening portion 72*k* formed in this head periphery-protecting cover 72 without protruding from the upper surface 72Bb of the arm member 72B.

Furthermore, when the head periphery-protecting cover 72 has reached the protection position P1, the outer peripheral surface other than the opening portion 72*k* by the cylindrical pipe 72A and the arm member 72B of the head periphery-protecting cover 72 protects the periphery other than the plurality of heat elements 32*a* provided in the thermal print head 32.

From the above, when the head periphery-protecting cover 72 has reached the protection position P1, the operator can observe the state of the plurality of heat elements 32*a* provided in the thermal print head 32 through the opening portion 72*k* from above the head periphery-protecting cover 72.

Accordingly, a harmful stain such as deposits deposited on the plurality of heat elements 32*a* in the previous stencil making of the thermal gauze 22 can be visually checked, and the harmful stain can be cleaned before stencil making this time, and thus a stencil making operation onto the thermal gauze 22 can be favorably carried out in the stencil making this time.

Subsequently, in the second operation in the second embodiment illustrated in FIG. 15, while the cylindrical pipe 72A of the head periphery-protecting cover 72 provided in the head portion 70 is pressed downward by the gauze frame 21 in a state where the platen opening/closing frame 44 in the platen portion 40 is kept open, the 15 front end portion 21*a* of this gauze frame 21 is mounted abutting while being positioned against the positioning member 19 fixed and placed on the upper surface 11*a* of the unit housing 11. Moreover, the movable positioning member 14 movable in accordance with the length size of the gauze frame 21 is caused to abut against the rear end portion 21*b* of the gauze frame 21 while being positioned and allows the rear end portion 21*b* side of this gauze frame 21 to be mounted.

Here, when the operator presses the cylindrical pipe 72A of the head periphery-protecting cover 72 downward by this gauze frame 21 while grasping the gauze frame 21, the head periphery-protecting cover 72 is pushed in while resisting the urging force of the torsion spring 75 and rotated in a counterclockwise direction around the rotating shaft 73 and lowered.

At this time, the plurality of heat elements 32*a* provided in the thermal print head 32 advances into the opening portion 72*k* of the head periphery-protecting cover 72 and approaches the thermal gauze 22 tightly stretched in the gauze frame 21.

Next, in the third operation in the second embodiment illustrated in FIG. 16, the platen opening/closing frame 44 in the platen portion 40 is closed, and the head periphery-protecting cover 72 is further lowered by the pressing piece 46 provided in this platen opening/closing frame 44.

Here, when the operator closes the platen opening/closing frame 44 of the platen portion 40, the platen roller 42 mounted on this platen opening/closing frame 44 comes into contact with the thermal gauze 22 tightly stretched in the gauze frame 21, and the locking claw 45 provided in the platen opening/closing frame 44 is locked to the locking pin 18 laterally provided on the inner side of the movable plate 12.

Furthermore, when the platen opening/closing frame 44 in the platen portion 40 is closed, the pressing piece 46 provided in this platen opening/closing frame 44 presses downward the cylindrical pipe 72A of the head periphery-protecting cover 72, and thus the head periphery-protecting cover 72 is further pushed in while resisting the urging force of the torsion spring 75 and is rotated around the rotating shaft 73 in the counterclockwise direction, and is further lowered from the position illustrated in FIG. 15 and reaches the protection release position P2.

Then, the plurality of heat elements 32*a* provided in the thermal print head 32 protrudes upward from the inside of the opening portion 72*k* of the head periphery-protecting cover 72 and comes into contact with the thermal gauze 22 tightly stretched in the gauze frame 21, and thus the thermal gauze 22 is sandwiched between the plurality of heat elements 32*a* and the platen roller 42.

After that, stencil making on the thermal gauze 22 can be carried out by moving the thermal print head 32 and the platen roller 42 in the sub-scanning direction of the thermal print head 32 integrally with the movable plate 12.

It is needless to say that, when the gauze frame 21 is not set in the unit housing 11, the head periphery-protecting cover 72 is automatically returned from the protection release position P2 to the protection position P1 by the urging force of the torsion spring 75.

First Modification of Second Embodiment

Subsequently, there will be described a first modification obtained by partially modifying the thermal stencil making unit 10B according to the second embodiment of the present invention.

Figure 17A:
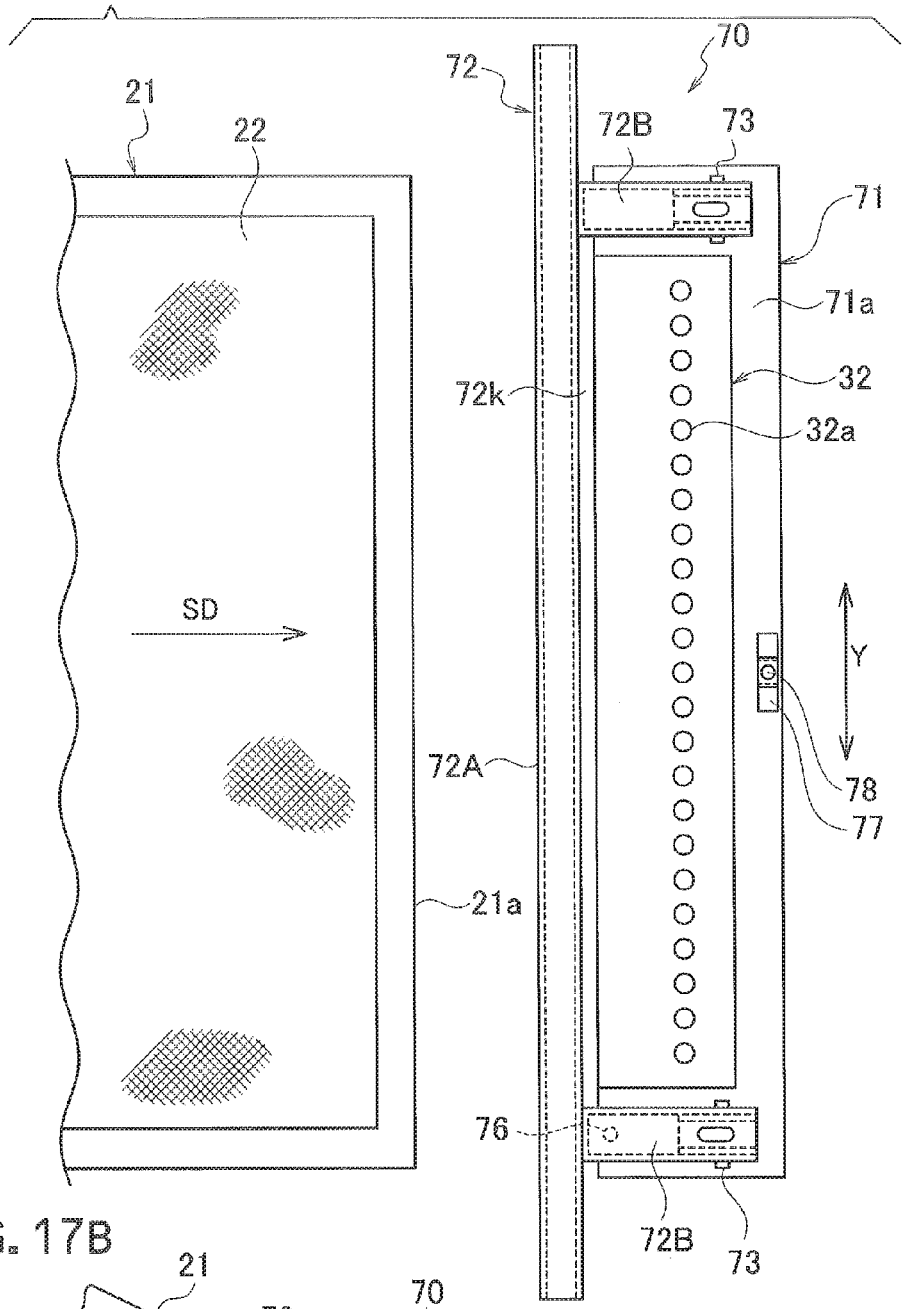
FIG. 17A is a top view illustrating the head portion in the first modification obtained by partially modifying the thermal stencil making unit according to the second embodiment of the present invention.
Figure 17B:
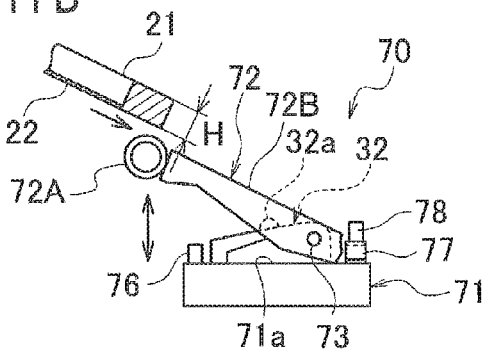
FIG. 17B is a side view illustrating the head portion in the first modification obtained by partially modifying the thermal stencil making unit according to the second embodiment of the present invention.

FIGS. 17A and 17B illustrate the head portion seen from an upper surface and a side surface, respectively, in the first modification obtained by partially modifying the thermal stencil making unit according to the second embodiment of the present invention.

The first modification obtained by partially modifying the thermal stencil making unit according to the second embodiment of the present invention illustrated in FIGS. 17A and 17B is different from the second embodiment only in that a detection operation of the gauze frame 21 and a detection operation of the thermal gauze 22 are constituted to be carried out when the gauze frame 21 in which the thermal gauze 22 is tightly stretched is to be set in the unit housing 11 and when stencil making is to be carried out on the thermal gauze 22, and thus points different from the second embodiment will be mainly described below.

Namely, as illustrated in FIGS. 17A and 17B, in the first modification obtained by partially modifying the thermal stencil making unit according to the second embodiment of the present invention, a gauze frame detection sensor 76 serving as a first detection sensor is mounted on a lower part on a back surface of the right arm member 72B of the pair of right and left arm members 72B and 72B of the head periphery-protecting cover 72 (head-protecting member), on the upper surface 71*a* of the head base 71 in the head portion 70.

Note that the gauze frame detection sensor 76 (first detection sensor) may be mounted at the lower part on the back surface of either one arm member 72B of the pair of right and left arm members 72B and 72B on the upper surface 71*a* of the head base 71.

The gauze frame detection sensor 76 described above detects whether or not the gauze frame 21 in which the thermal gauze 22 is tightly stretched is set in the unit housing 11, in other words, detects the presence or absence of the gauze frame 21. In addition, the gauze frame detection sensor 76 detects whether or not the head periphery-protecting cover 72 has moved from the protection position P1 where the thermal print head 32 is protected and has reached the protection release position P2.

Furthermore, a thermal gauze detection sensor 78 serving as a second detection sensor is mounted via a bracket 77 having a predetermined height, at substantially the center portion in the longitudinal direction (arrow Y-direction) on the upper surface 71*a* of the head base 71.

The thermal gauze detection sensor 78 (second detection sensor) described above detects whether or not the thermal gauze 22 is tightly stretched on a lower surface of the gauze frame 21 when the gauze frame 21 is regularly set in the unit housing 11 or in other words, detects the presence or absence of the thermal gauze 22.

At this time, the gauze frame detection sensor 76 and the thermal gauze detection sensor 78 both use a known reflection-type optical sensor and a detection distance of this reflection-type optical sensor is approximately 5 mm and a detection range is set to approximately ±2 mm around that point.

Along with the above, in the gauze frame detection sensor 76 and the thermal gauze detection sensor 78, mounting heights of the gauze frame detection sensor 76 and the thermal gauze detection sensor 78 are adjusted by using the bracket 77 or the like so that a reflection surface to be detected is located within a detection range of 3 to 7 mm from distal ends of the gauze frame detection sensor 76 and the thermal gauze detection sensor 78.

In addition, in a case where the thermal gauze 22 tightly stretched on the lower surface of the gauze frame 21 is regularly set in the unit housing 11 when the gauze frame detection sensor 76 and the thermal gauze detection sensor 78 both having characteristics described above are used, the thermal gauze 22 is located within the detection range (5 mm+2 mm) of the thermal gauze detection sensor 78, and thereby the presence or absence of the thermal gauze 22 can be detected by the thermal gauze detection sensor 78.

On the other hand, in a case where the user erroneously sets the gauze frame 21 upside down in the unit housing 11, since a height H of the gauze frame 21 is generally 20 mm or more, the thermal gauze 22 is located upward by the height H from the regular position, and thereby this thermal gauze 22 cannot be detected by the thermal gauze detection sensor 78.

Therefore, the thermal gauze detection sensor 78 is also capable of up-and-down inversion detection of the gauze frame other than detection of the presence or absence of the thermal gauze 22 regularly set to the gauze frame 21.

Here, there will be described, by the use of FIGS. 18 to 21, the operation of the first modification obtained by partially modifying the thermal stencil making unit 10B according to the second embodiment of the present invention constituted by mounting the gauze frame detection sensor 76 and the thermal gauze detection sensor 78 on the head base 71 as above.

Figure 18:
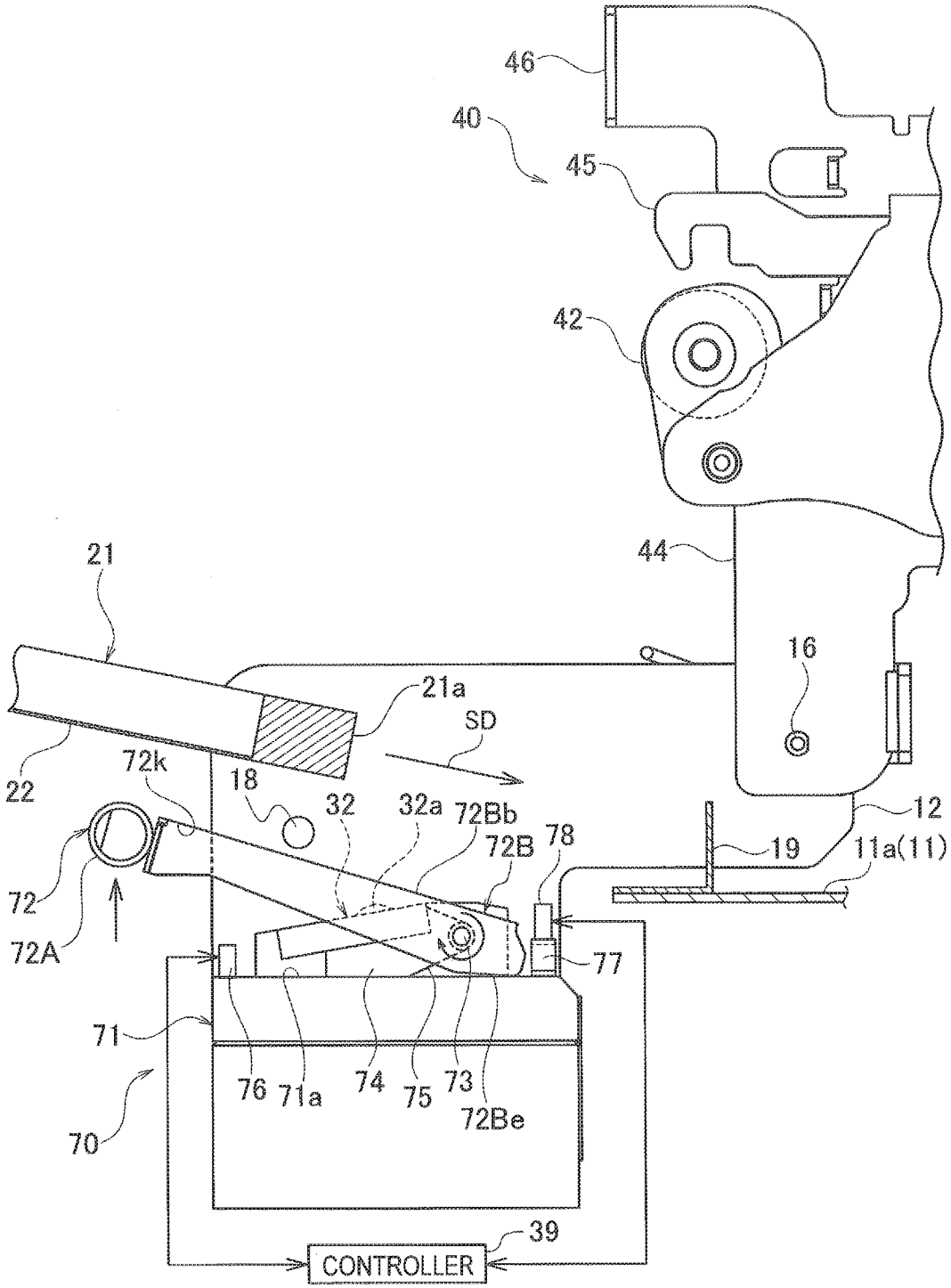
FIG. 18 is a first operation diagram illustrating an operation of the first modification obtained by partially modifying the thermal stencil making unit according to the second embodiment of the present invention.
Figure 19:
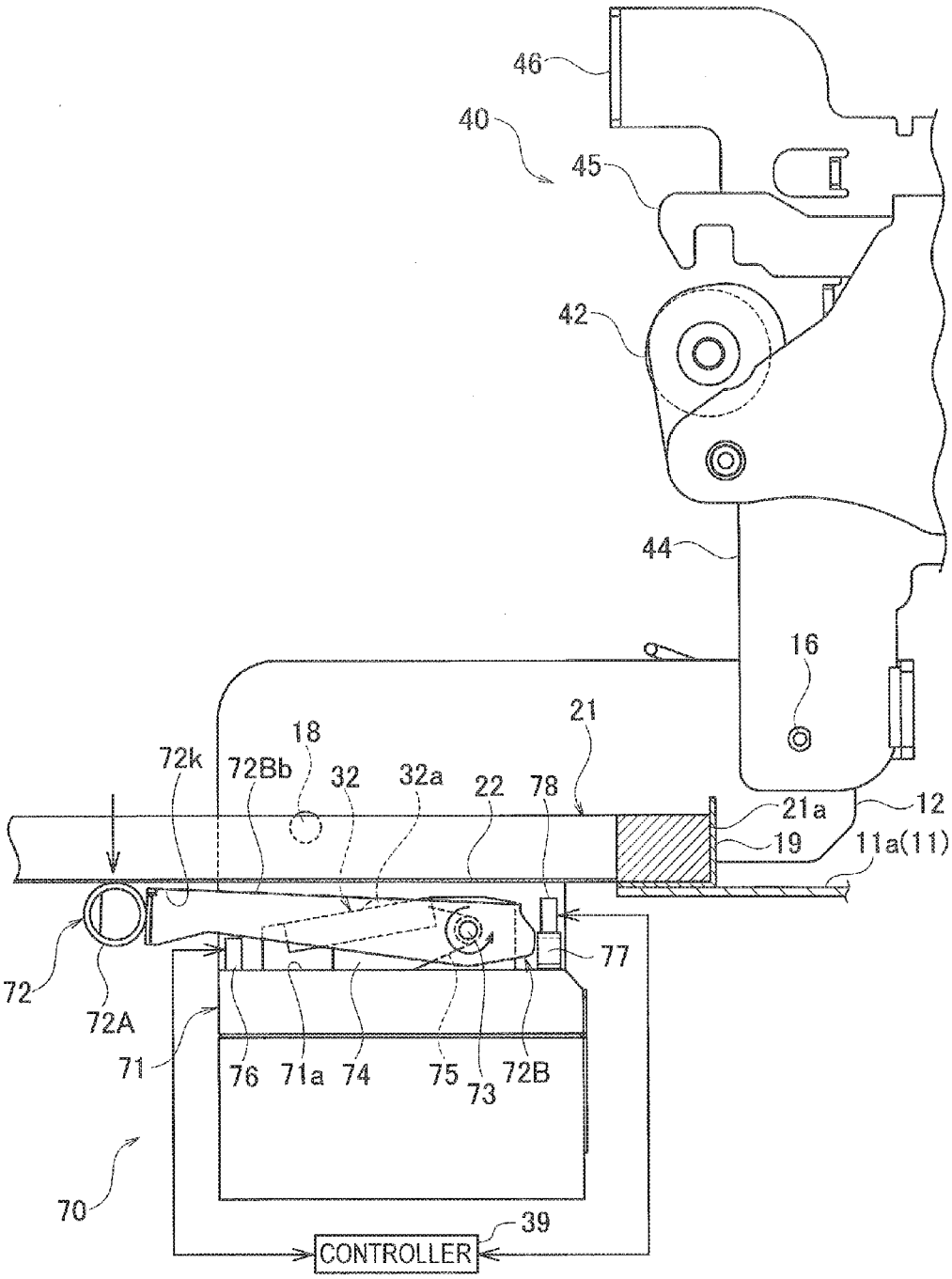
FIG. 19 is a second operation diagram illustrating the operation of the first modification obtained by partially modifying the thermal stencil making unit according to the second embodiment of the present invention.
Figure 20:
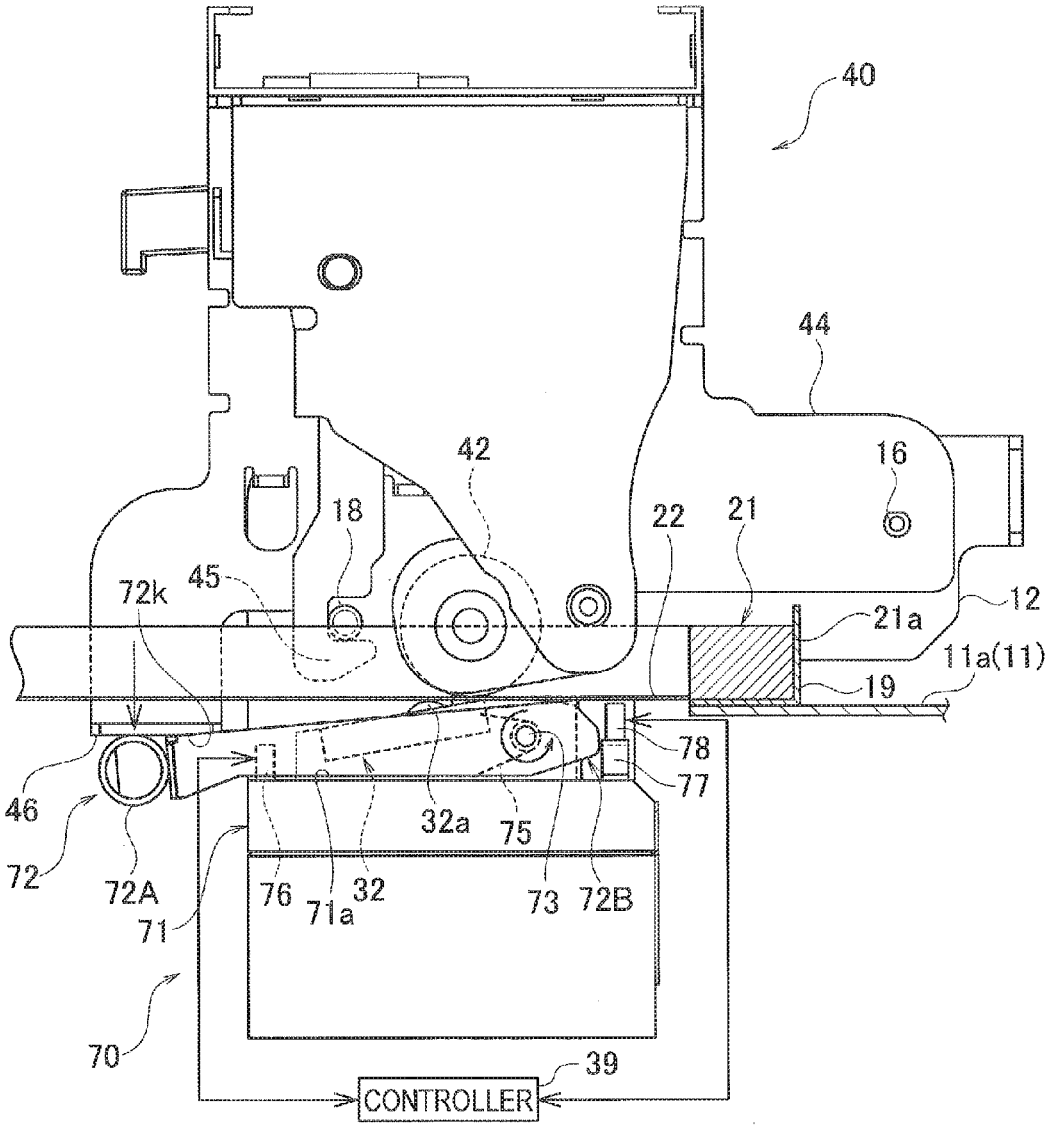
FIG. 20 is a third operation diagram illustrating the operation of the first modification obtained by partially modifying the thermal stencil making unit according to the second embodiment of the present invention.

FIGS. 18 to 20 schematically illustrate first to third operations for describing the operation of the first modification obtained by partially modifying the thermal stencil making unit according to the second embodiment of the present invention.

Note that, in FIGS. 18 to 20, only a right side surface side of the unit is described in illustration, and description for a left side surface side symmetric to the right side surface side will be omitted.

First, in the first operation in the first modification of the second embodiment illustrated in FIG. 18, the platen opening/closing frame 44 in the platen portion 40 is in the open state around the rotating shaft 16. In this state, the head periphery-protecting cover 72 mounted, via the bracket 74, on the upper surface 71*a* of the head base 71 provided in the head portion 70 is raised while rotating in the clockwise direction around the rotating shaft 73 by the urging force of the torsion spring 75 fitted in the rotating shaft 73 and has reached the protection position P1 where the thermal print head 32 is protected.

Then, when the head periphery-protecting cover 72 has reached the protection position P1, the operator starts the setting operation by directing the gauze frame 21 toward the setting direction SD of the gauze frame 21 with the front end portion 21*a* side of this gauze frame 21 at the head while grasping the gauze frame 21 in which the thermal gauze 22 is tightly stretched, from above the head periphery-protecting cover 72.

In addition, when the head periphery-protecting cover 72 has reached the protection position P1, the plurality of heat elements 32*a* provided in the thermal print head 32 faces the inside of the opening portion 72*k* formed in this head periphery-protecting cover 72 without protruding from the upper surface 72Bb of the arm member 72B.

Furthermore, when the head periphery-protecting cover 72 has reached the protection position P1, the outer peripheral surface other than the opening portion 72*k* by the cylindrical pipe 72A and the arm member 72B of the head periphery-protecting cover 72 protects the periphery other than the plurality of heat elements 32*a* provided in the thermal print head 32.

Moreover, in this first operation, the gauze frame detection sensor 76 mounted on the upper surface 71*a* of the head base 71 is largely separated from the back surface of the right-side arm member 72B of the head periphery-protecting cover 72 which has risen to the protection position P1. Therefore, the controller 39 detects according to the detection result from the gauze frame detection sensor 76 that "there is no gauze frame" and "the head periphery-protecting cover has not reached the protection release position P2".

On the other hand, the thermal gauze detection sensor 78 mounted on the upper surface 71*a* of the head base 71 via the bracket 77 is largely separated from the thermal gauze 22 tightly stretched on the lower surface of the gauze frame 21 during the gauze frame setting operation. Therefore, the controller 39 detects according to the detection result from the thermal gauze detection sensor 78 that "there is no thermal gauze".

Subsequently, in the second operation in the first modification of the second embodiment illustrated in FIG. 19, while the cylindrical pipe 72A of the head periphery-protecting cover 72 provided in the head portion 70 is pressed downward by the gauze frame 21 in a state where the platen opening/closing frame 44 in the platen portion 40 is kept open, the front end portion 21*a* of this gauze frame 21 is mounted abutting against the positioning member 19 and being positioned on this positioning member 19, fixed and placed on the upper surface 11*a* of the unit housing 11.

After that, the user causes the movable positioning member 14 movable in accordance with the length size of the gauze frame 21 to abut against the rear end portion 21*b* of the gauze frame 21 while positioning the movable positioning member 14, to thereby mount the rear end portion 21*b* of this gauze frame 21, and then fixes the movable positioning member 14 by a fixing means not shown.

Here, when the operator presses downward the cylindrical pipe 72A of the head periphery-protecting cover 72 by this gauze frame 21 while grasping the gauze frame 21, the head periphery-protecting cover 72 is pushed in against the urging force of the torsion spring 75 and rotated around the rotating shaft 73 in the counterclockwise direction and lowered.

At this time, the plurality of heat elements 32*a* provided in the thermal print head 32 advances into the opening portion 72*k* of the head periphery-protecting cover 72 and approaches the thermal gauze 22 tightly stretched in the gauze frame 21.

In addition, in this second operation, the gauze frame detection sensor 76 mounted on the upper surface 71*a* of the head base 71 approaches the back surface of the right-side arm member 72B of the lowered head periphery-protecting cover 72.

At this time, the position of the back surface of the right-side arm member 72B of the head periphery-protecting cover 72 has not yet reached within the detection range (5 mm±2 mm) of the gauze frame detection sensor 76. Therefore, the controller 39 detects according to the detection result from the gauze frame detection sensor 76 that "there is no gauze frame" and "the head periphery-protecting cover has not reached the protection release position P2".

On the other hand, the thermal gauze detection sensor 78 mounted on the upper surface 71*a* of the head base 71 via the bracket 77 approaches the thermal gauze 22 tightly stretched on the lower surface of the gauze frame 21 regularly mounted on the movable positioning member 14 and the positioning member 19.

At this time, the position of the thermal gauze 22 has reached within the detection range (5 mm+2 mm) of the thermal gauze detection sensor 78. Therefore, the controller 39 detects according to the detection result from the thermal gauze detection sensor 78 that "there is thermal gauze".

Next, in the third operation in the first modification of the second embodiment illustrated in FIG. 20, the platen opening/closing frame 44 in the platen portion 40 is closed, and the head periphery-protecting cover 72 is further lowered by the pressing piece 46 provided in this platen opening/closing frame 44.

Here, when the operator closes the platen opening/closing frame 44 of the platen portion 40, the platen roller 42 mounted on this platen opening/closing frame 44 comes into contact with the thermal gauze 22 tightly stretched in the gauze frame 21, and the locking claw 45 provided in the platen opening/closing frame 44 is locked to the locking pin 18 laterally provided on the inner side of the movable plate 12.

Furthermore, when the platen opening/closing frame 44 in the platen portion 40 is closed, the pressing piece 46 provided in this platen opening/closing frame 44 presses downward the cylindrical pipe 72A of the head periphery-protecting cover 72, and thus the head periphery-protecting cover 72 is further pushed in while resisting the urging force of the torsion spring 75 and is rotated around the rotating shaft 73 in the counterclockwise direction, and is further lowered from the position illustrated in FIG. 15 and reaches the protection release position P2.

Moreover, in this third operation, the gauze frame detection sensor 76 mounted on the upper surface 71*a* of the head base 71 approaches the back surface of the right-side arm member 72B of the head periphery-protecting cover 72 pressed by the pressing piece 46 provided in the platen opening/closing frame 44.

At this time, the position of the back surface of the right-side arm member 72B of the head periphery-protecting cover 72 has reached within the detection range (5 mm±2 mm) of the gauze frame detection sensor 76. Therefore, the controller 39 detects according to the detection result from the gauze frame detection sensor 76 that "there is gauze frame" and "the head periphery-protecting cover has reached the protection release position P2".

On the other hand, the thermal gauze detection sensor 78 mounted on the upper surface 71*a* of the head base 71 via the bracket 77 further approaches the thermal gauze 22 more than in the second operation, but as in the case of the second operation, the controller 39 detects according to the detection result from the thermal gauze detection sensor 78 that "there is thermal gauze".

After that, stencil making on the thermal gauze 22 can be carried out by moving the thermal print head 32 and the platen roller 42 in the sub-scanning direction of the thermal print head 32 integrally with the movable plate 12.

As described above, in the first modification of the second embodiment, there are provided the gauze frame detection sensor 76 (first detection sensor) detecting that the gauze frame 21 is set by the head periphery-protecting cover 72 when the head periphery-protecting cover 72 (head-protecting member) has moved from the protection position P1 to the protection release position P2, and the thermal gauze detection sensor 78 (second detection sensor) detecting the presence or absence of the thermal gauze 22 when the gauze frame 21 is set in the unit housing 11.

Accordingly, since detection of the presence or absence of the gauze frame 21 formed in a general shape and detection of the presence or absence of the thermal gauze 22 become possible without the use of a gauze frame exclusively for a device specially formed, damage of various constituent members can be previously prevented by grasping an abnormal state in the thermal stencil making unit 10B, and since stencil making on the thermal gauze 22 can be reliably carried out, and thereby a contribution can be made to enhancement of reliability of the thermal stencil making unit 10B.

Incidentally, in the first to third operations in the first modification of the second embodiment illustrated in FIGS. 18 to 20, the operation of detecting the presence or absence of the gauze frame 21 and the presence or absence of the thermal gauze 22 when the gauze frame 21 is to be set in the unit housing 11 is described, but in the first modification of this second embodiment, the presence or absence of the gauze frame 21 and the presence or absence of the thermal gauze 22 are detected also in the middle of making a stencil on th the thermal gauze 22.

The reason for that is that, when the gauze frame 21 is to be mounted on the movable positioning member 14 and the positioning member 19 in the unit housing 11, as described above, the user causes the front end portion 21*a* side of the gauze frame 21 to abut against the positioning member 19 and to be mounted, causes the movable positioning member 14 movable in accordance with the length size of the gauze frame 21 to abut against the rear end portion 21*b* side of the gauze frame 21 while positioning the movable positioning member 14 to thereby mount the rear end portion 21*b* of this gauze frame 21, and fixes the movable positioning member 14 by the fixing means not shown.

However, because of carelessness of the user, if the user starts stencil making on the thermal gauze 22 while forgetting to fix the movable positioning member 14 movable in accordance with the length size of the gauze frame 21, there is generated an abnormal situation in which the movable positioning member 14 moves in the middle of stencil making on the thermal gauze 22, and the gauze frame 21 drops from the movable positioning member 14 or the gauze frame 21 moves forward and backward, and a stencil cannot made onto the thermal gauze 22 normally.

Figure 21:
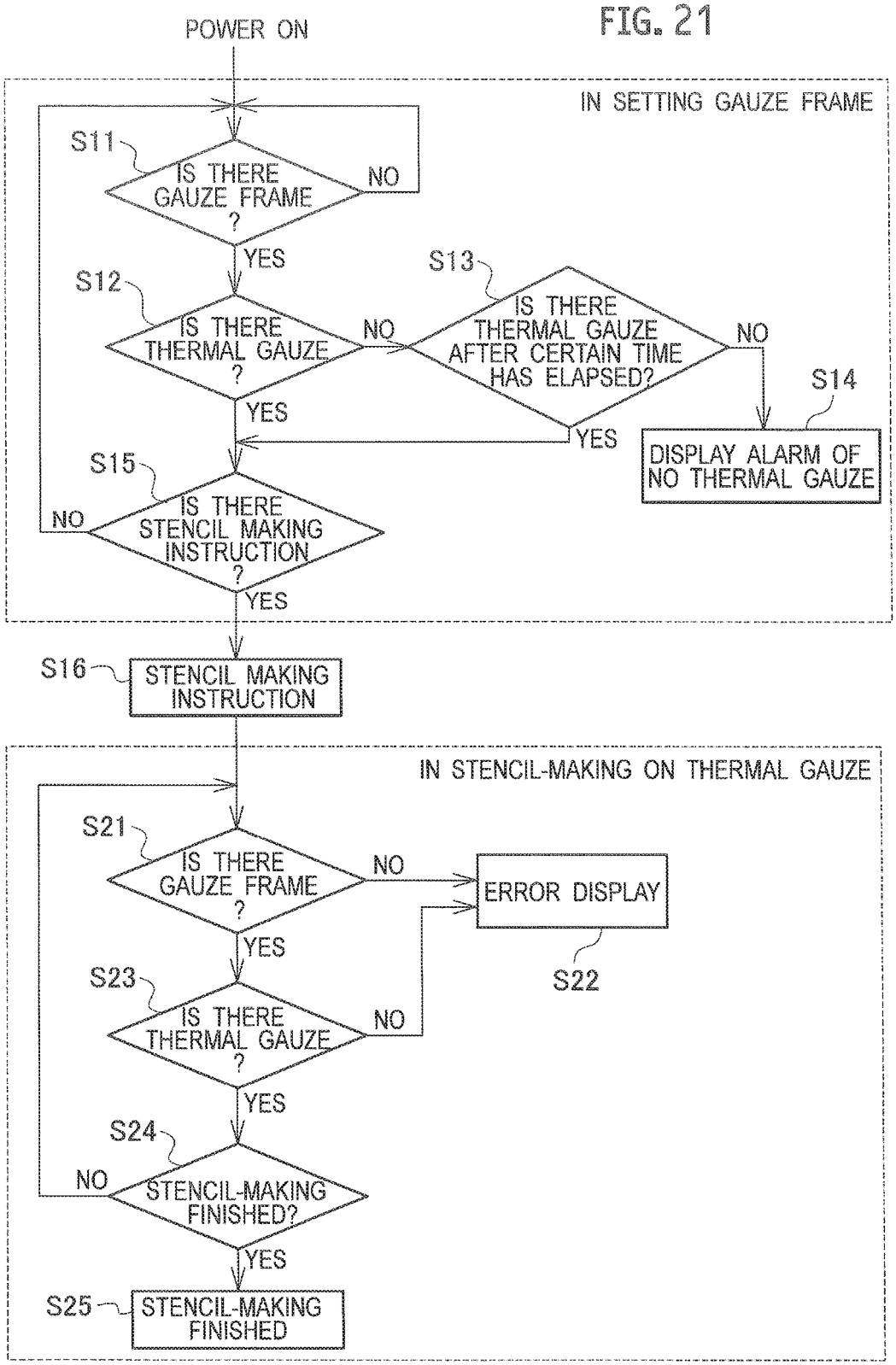
FIG. 21 is a flowchart illustrating a detection operation of the gauze frame and a detection operation of the thermal gauze, in the first modification obtained by partially modifying the thermal stencil making unit according to the second embodiment of the present invention.

Accordingly, in order to previously avoid the abnormal situation by detecting the abnormal stencil making state as above, in the first modification of this second embodiment, the presence or absence detection of the gauze frame 21 and the presence or absence detection of the thermal gauze 22 are carried out via the controller 39 in the setting of the gauze frame and in stencil making on the thermal gauze as illustrated in FIG. 21 below.

FIG. 21 illustrates the gauze frame detection operation and the thermal gauze detection operation in the first modification obtained by partially modifying the thermal stencil making unit according to the second embodiment of the present invention. Note that, in a flow illustrated in FIG. 21, determination processing to the gauze frame detection sensor 76 and the thermal gauze detection sensor 78 is carried out in the controller 39, but illustration of the gauze frame detection sensor 76 and the thermal gauze detection sensor 78 is omitted in the description.

As illustrated in FIG. 21, after power not shown is turned on, when the gauze frame 21 is to be set in the unit housing 11, first, whether or not there is the gauze frame is asked at Step S11.

If a detection result of the gauze frame detection sensor 76 at this Step S11 is "OFF", the gauze frame 21 is in a NO state of not being set in the unit housing 11, and thus the process proceeds to Step S11 again.

On the other hand, if the detection result of the gauze frame detection sensor 76 is "ON" at Step S11, the gauze frame 21 is in a YES state of being set in the unit housing 11, and thus process proceeds to Step S12.

Subsequently, at Step S12, whether or not there is the thermal gauze is asked.

If the detection result of the thermal gauze detection sensor 78 is "OFF" at this Step S12, the thermal frame 22 is in a NO state of not being tightly stretched in the gauze frame 21, and thus process proceeds to Step S13.

Subsequently, at Step S13, whether or not there is the thermal gauze is asked again after a certain time has elapsed, with the time when the presence of the gauze frame is detected at Step S11 as a calculation start point. The reason why whether or not there is the thermal gauze is asked again after the certain time has elapsed from the point of time when the presence of the gauze frame is detected at this Step S13 is that, in some cases, only the gauze frame 21 is detected while the thermal gauze 22 is not detected, if the gauze frame 21 is not set from the perpendicular direction, or for example, if the gauze frame 21 is set from an oblique direction.

In addition, if the detection result of the thermal gauze detection sensor 78 is still "OFF" at Step S13 even after the certain time has elapsed, the thermal gauze 22 is in a NO state of not being tightly stretched in the gauze frame 21, and thus "alarm of no thermal gauze is displayed" to the user at Step S14.

On the other hand, if the detection result of the thermal gauze detection sensor 78 is "ON" at Step S12 or Step S13, the thermal gauze 22 is in a YES state of being tightly stretched in the gauze frame 21, and thus process proceeds to Step S15.

Subsequently, whether or not there is an instruction of stencil making to the thermal gauze 22 is asked at Step S15. If there is no stencil making instruction at this Step S15 (in the case of NO), the process returns to Step S11. On the other hand, if there is a stencil making instruction at Step S15 (in the case of YES), the stencil making instruction is made at Step S16, and stencil making on the thermal gauze 22 is started.

After that, the presence or absence detection of the gauze frame 21 and presence or absence detection of the thermal gauze 22 are carried out during the stencil making on the thermal gauze 22.

Namely, in the thermal gauze stencil-making when the stencil is made on the thermal gauze 22, whether or not there is the gauze frame is asked at Step S21.

In a case where it is determined at this Step S21 from the detection result of the gauze frame detection sensor 76 that there is no gauze frame 21 (in the case of NO), an error display is made at Step S22, whereas in a case where it is determined that there is the gauze frame 21 (in the case of YES), whether or not there is the thermal gauze is asked at Step S23.

In a case where it is determined at this Step S23 from the detection result of the 10 thermal gauze detection sensor 78 that there is no thermal gauze 22 (in the case of NO), an error display is made at Step S22, whereas in a case where it is determined that there is the thermal gauze 22 (in the case of YES), whether or not the stencil making is finished is asked at Step S24.

In a case where it is determined at this Step S24 that the stencil making is not finished (in the case of NO), the routine returns to Step S21, whereas in a case where it is determined that the stencil making is finished (in the case of YES), this flow is completed by finishing the stencil making on the thermal gauze 22 at Step S25.

From the above, according to the first modification of the second embodiment, the presence or absence detection of the gauze frame 21 and the presence or absence detection of the thermal gauze 22 are carried out at Steps S11 to S15 in the setting of the gauze frame and at Steps S21 to S24 in the thermal gauze stencil-making.

At this time, particularly, when the user makes a stencil on the thermal gauze 22 while the user forgets to fix the movable positioning member 14 on which the rear end portion 21*b* side of the gauze frame 21 is mounted, there can be detected an abnormal situation in which the movable positioning member 14 moves in the middle of stencil making on the thermal gauze 22 and thus the gauze frame 21 drops from the movable positioning member 14, or the gauze frame 21 moves back and forth, with the result that a contribution can be made to enhancement of reliability of the first modification of the second embodiment.

Note that, although not shown here, in the first embodiment of the present invention described by the use of FIGS. 1 to 9 and also in the first and second modifications obtained by partially modifying this first embodiment, when the thermal gauze detection sensor (second detection sensor) is mounted on the head base 71 of the head portion 30, whether or not the head periphery-protecting cover 33 or 60 (head-protecting member) has moved from the protection position P1 where the thermal print head 32 is protected and has reached the protection release position P2 is detected by the micro switch 38 (first detection sensor) via the controller 39, and thereby the flow illustrated in FIG. 21 can be executed similarly to the first modification of the second embodiment.

Second Modification of Second Embodiment

Subsequently, there will be described, by the use of FIG. 22, a second modification obtained by partially modifying the thermal stencil making unit 10B according to the second embodiment of the present invention.

Figure 22:
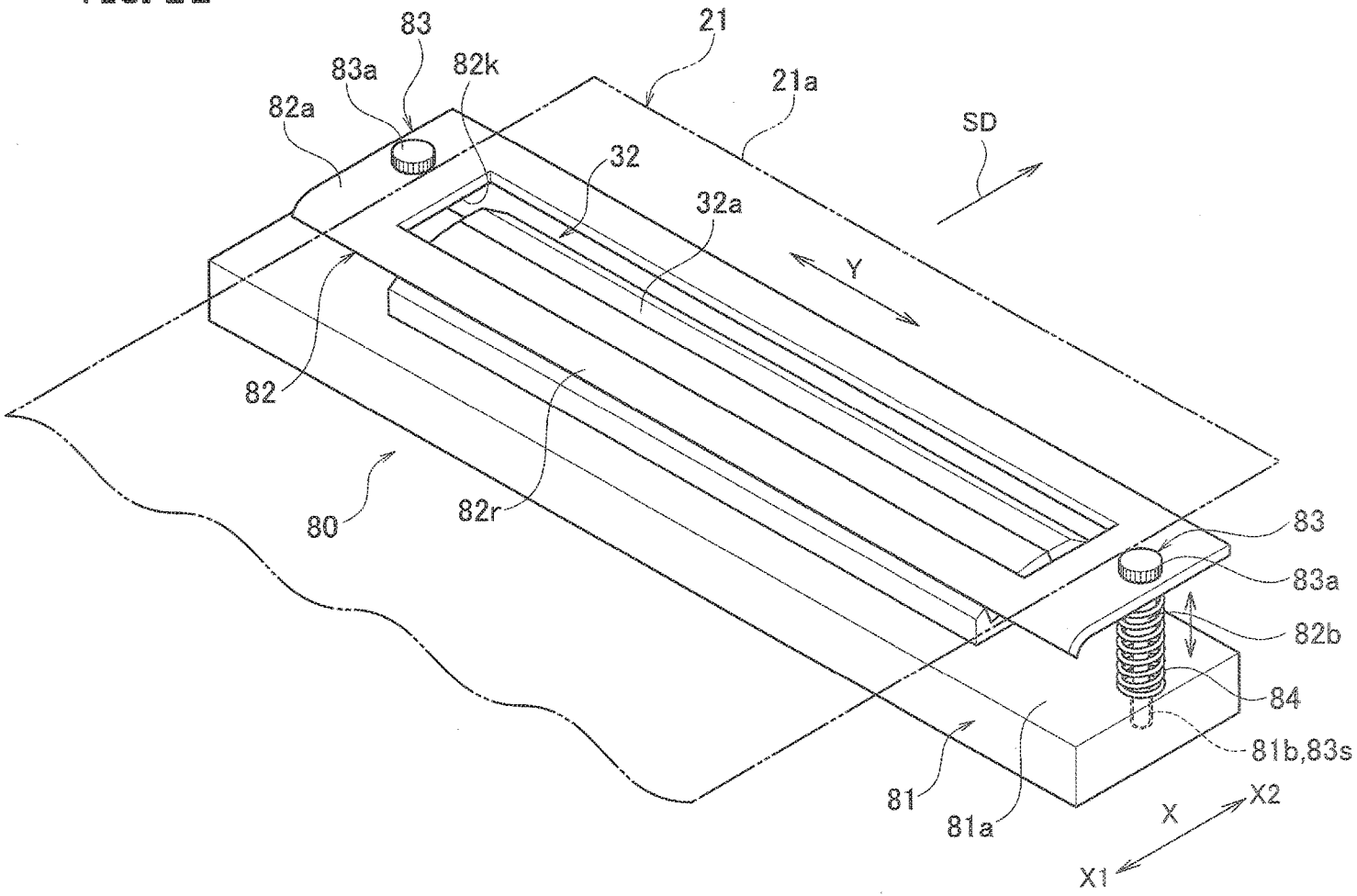
FIG. 22 is a perspective view illustrating the second modification obtained by partially modifying the thermal stencil making unit according to the second embodiment of the present invention.

FIG. 22 perspectively illustrates the second modification obtained by partially modifying the thermal stencil making unit according to the second embodiment of the present invention.

In the second modification obtained by partially modifying the thermal stencil making unit according to the second embodiment of the present invention illustrated in FIG. 22, only a head-protecting member 82 provided on a head base 81 in a head portion 80 is different from the head-protecting member 72 illustrated in FIGS. 10 to 16 described above.

Namely, as illustrated in FIG. 22, the second modification of the second embodiment is different from the second embodiment in that the head-protecting member 82 movable in the vertical direction between the protection position P1 and the protection release position P2 is used instead of the rotatable head-protecting member 72 in the second embodiment and the first modification of the second embodiment.

In the second modification of this second embodiment, the head-protecting member 82 is a head-periphery-protecting member that has an opening portion 82*k* through which the plurality of heat elements 32*a* provided in the thermal print head 32 advances and retreats and that protects the plurality of heat elements 32*a* at the protection position P1 where the thermal print head 32 is protected in a periphery on an advance direction side of the gauze frame 21. At this time, the periphery on the advance direction side of the gauze frame 21 is a periphery other than the opening portion 82*k* of the head periphery-protecting cover 82.

Then, when the head-protecting member 82 (hereinafter, referred to as a head periphery-protecting cover) has reached the protection position P1, unlike the first embodiment, the plurality of heat elements 32*a* provided in the thermal print head 32 can be visually recognized without being hidden by the opening portion 82*k* formed in the head periphery-protecting cover 82, and improvement is made such that the thermal print head 32 is protected when the gauze frame 21 is set, by protection (covering) of the periphery other than the plurality of heat elements 32*a* by the periphery other than the opening portion 82*k* of the head periphery-protecting cover 82.

The head periphery-protecting cover 82 described above is movably provided in a vertical direction (up-and-down direction) between the protection position P1 and the protection release position P2 around a pair of right and left rotating shafts 83 and 83 provided across the longitudinal direction (arrow Y-direction) of the thermal print head 32 and in the vicinity of right and left sides on one end side of the thermal print head 32 on the upper surface 81*a* of the head base 81.

Then, the head base 81 obtained by mounting the thermal print head 32 and the head periphery-protecting cover 82 is mounted on the pair of right and left movable plates 12 and 12 reciprocating in the arrow X-direction while facing each other at intervals in the arrow Y-direction which is the main scanning direction of the thermal print head 32, as in the second embodiment.

Here, the head periphery-protecting cover 82 (head-protecting member) serving as an essential part of the second modification of the second embodiment is formed to be lightweight by the use of, for example, a resin material having rigidity and abrasion resistance.

In addition, as will be described later, when the gauze frame 21 is to be set from the setting direction SD in a state where the head periphery-protecting cover 82 has risen to the protection position P1, an R portion 82*r* is formed on one end side of the flat upper surface 82*a* toward the setting direction SD of the gauze frame 21 and this R portion 82*r* guides the setting of the gauze frame 21 so that the setting can be smoothly carried out without the front end portion 21*a* of the gauze frame 21 being hooked by the head periphery-protecting cover 82.

Furthermore, the opening portion 82*k* that faces the plurality of heat elements 32*a* provided in the thermal print head 32 is largely opened in the upper surface 82*a* of the head periphery-protecting cover 82.

Moreover, a pair of right and left boss portions 82*b* and 82*b* are formed downward on the back surface of the upper surface 82*a* of the head periphery-protecting cover 82 and on an outer side from the right and left side surfaces of the gauze frame 21, the pair of right and left shafts with screws 83 and 83 are inserted from the upper surface 82*a* side into boss holes not shown, formed in the pair of right and left boss portions 82*b* and 82*b*, and male screw portions 83*s* and 83*s* formed below the pair of right and left shafts with screws 83 and 83 are screwed with a pair of right and left female screw portions 81*b* and 81*b* formed in the head base 81.

In addition, a pair of right and left compression springs 84 and 84 are fitted into the pair of right and left boss portions 82*b* and 82*b* provided in the back surface of the upper surface 82*a* of the head periphery-protecting cover 82, and the pair of these right and left compression springs 84 and 84 are locked between the upper surface 81*a* of the head base 81 and the back surface of the upper surface 82*a* of the head periphery-protecting cover 82.

Accordingly, the head periphery-protecting cover 82 is urged upward by the pair of right and left compression springs 84 and 84 and the height at the protection position P1 is regulated by head portions 83*a* and 83*a* of the pair of right and left shafts with screws 83 and 83.

Here, there will be described, by the use of FIGS. 23 to 25, the operation of the second modification of the second embodiment when the head periphery-protecting cover 82 is supported capable of vertical movement (up-and-down movement) on the head base 81 across the longitudinal direction of the thermal print head 32, as described above.

Figure 23:
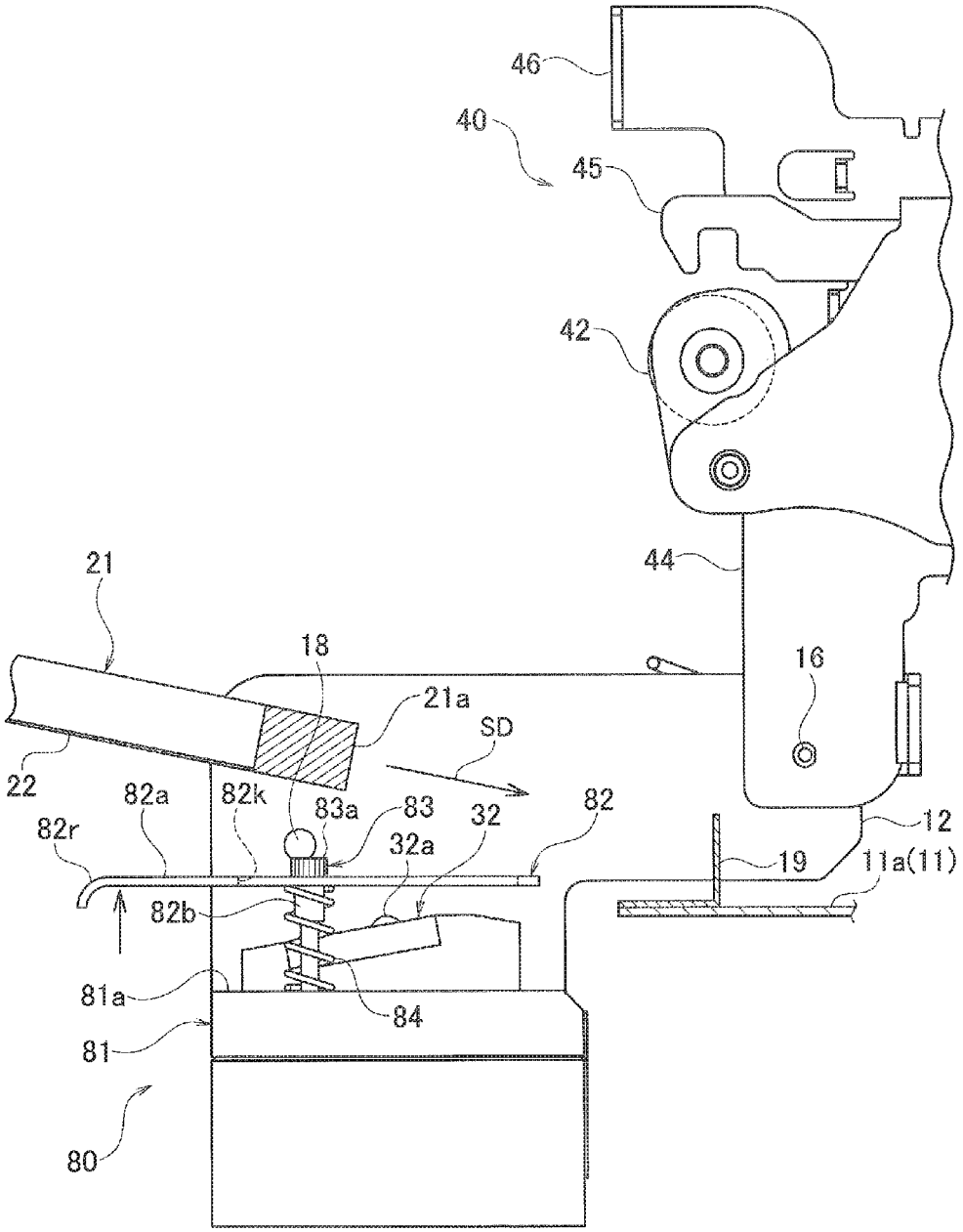
FIG. 23 is a first operation diagram illustrating an operation of the second modification obtained by partially modifying the thermal stencil making unit according to the second embodiment of the present invention.
Figure 24:
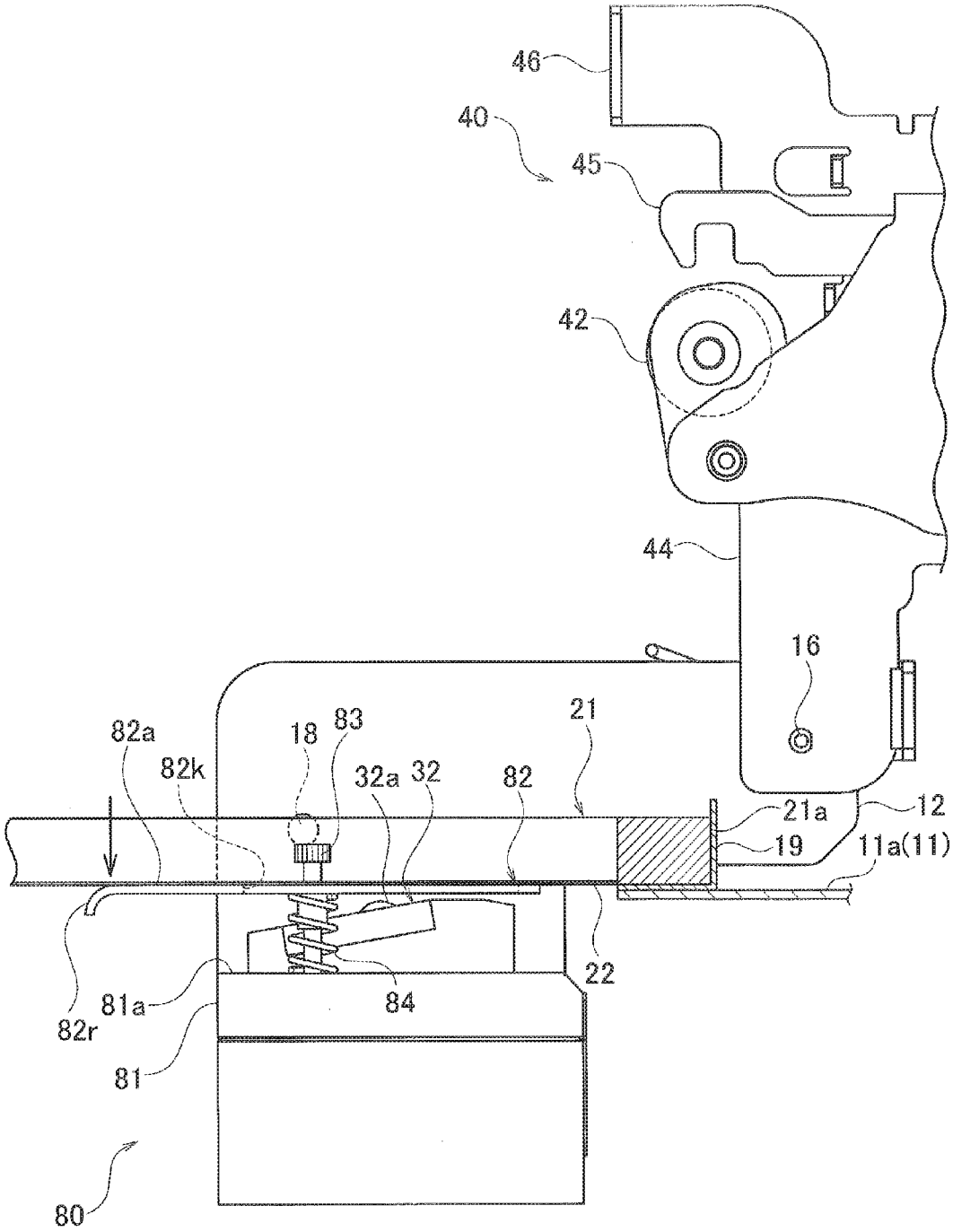
FIG. 24 is a second operation diagram illustrating the operation of the second modification obtained by partially modifying the thermal stencil making unit according to the second embodiment of the present invention.
Figure 25:
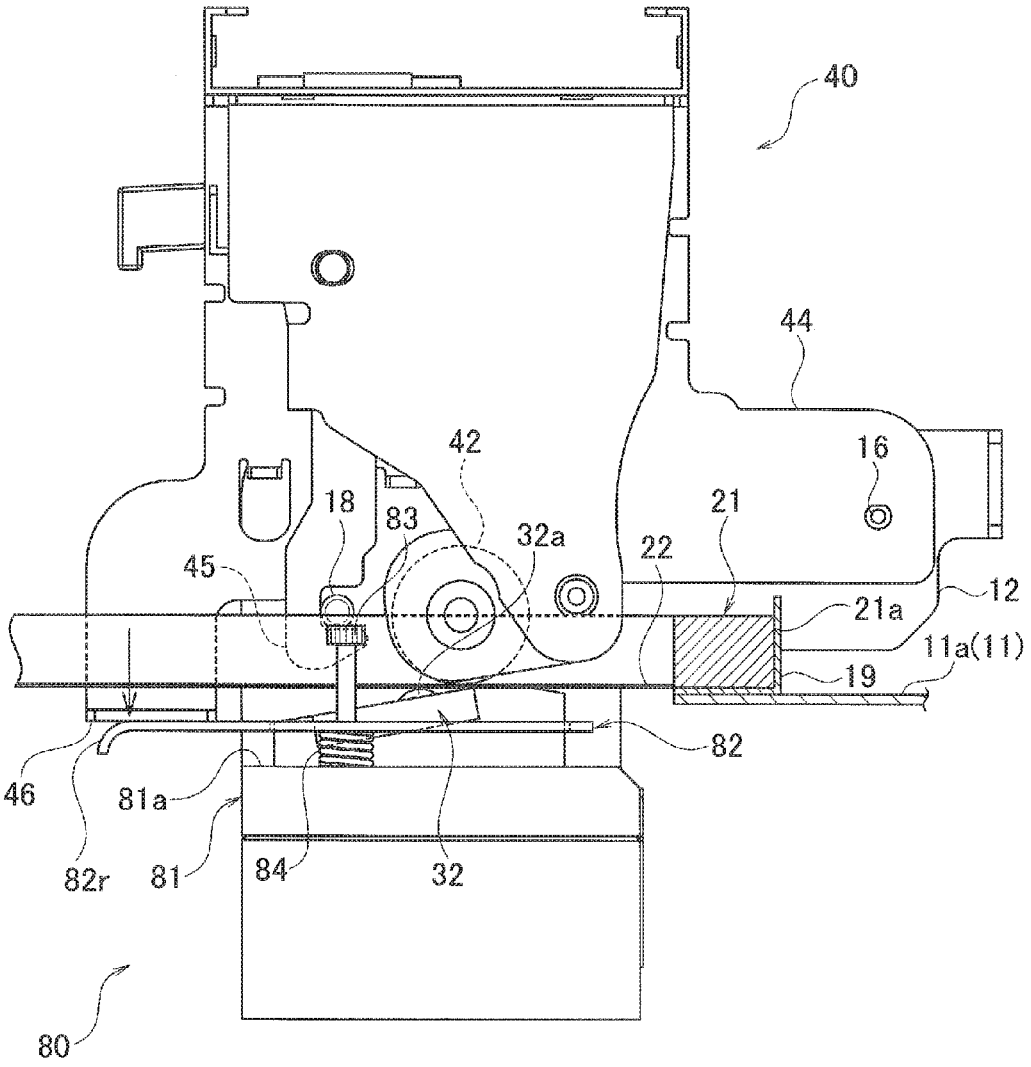
FIG. 25 is a third operation diagram illustrating the operation of the second modification obtained by partially modifying the thermal stencil making unit according to the second embodiment of the present invention.

FIGS. 23 to 25 schematically illustrate first to third operations for describing the operation of the second modification of the second embodiment.

Note that, in FIGS. 23 to 25, only a right side surface side of the unit is described in illustration, and description for a left side surface side symmetric to the right side surface side will be omitted.

Moreover, in FIGS. 23 to 25, on a front of the head portion 80 in the second modification of the second embodiment, unlike the first embodiment, the positioning member 19 that positions the front end portion 21*a* side of the gauze frame 21 and causes the front end portion 21*a* side of the gauze frame 21 to be mounted is assumed to be fixed and placed on the upper surface 11*a* of the unit housing 11.

First, in the first operation in the second modification of the second embodiment illustrated in FIG. 23, the platen opening/closing frame 44 in the platen portion 40 is in the open state around the rotating shaft 16. In this state, the head periphery-protecting cover 82 mounted, via the shaft with screw 83, on the upper surface 81*a* of the head base 81 provided in the head portion 80 is raised in the vertical direction by the urging force of the compression spring 84 fitted into the boss portion 82*b* and has reached the protection position P1 where the thermal print head 32 is protected.

At this time, since the head portion 83*a* of the shaft with screw 83 comes into contact with the upper surface 82*a* of the head periphery-protecting cover 82, the height of the head periphery-protecting cover 82 at the protection position P1 is regulated.

Then, when the head periphery-protecting cover 82 has reached the protection position P1, the operator starts the setting operation by directing the gauze frame 21 toward the setting direction SD of the gauze frame 21 with the front end portion 21*a* side of this gauze frame 21 at the head while grasping the gauze frame 21 in which the thermal gauze 22 is tightly stretched, from above the head periphery-protecting cover 82.

At this time, since the R portion 82*r* of the head periphery-protecting cover 82 is directed to the setting direction SD of the gauze frame 21 and guides the setting of the gauze frame 21, the setting operation can be smoothly carried out even if the front end portion 21*a* of the gauze frame 21 comes into contact with the R portion 82*r* of the head periphery-protecting cover 82.

In addition, when the head periphery-protecting cover 82 has reached the protection position P1, the plurality of heat elements 32*a* provided in the thermal print head 32 is faced with an inside of the opening portion 82*k* formed in this head periphery-protecting cover 82 without protruding from the upper surface 82*a* of the head periphery-protecting cover 82.

Moreover, when the head periphery-protecting cover 82 has reached the protection position P1, the outer peripheral surface other than the opening portion 82*k* of the head periphery-protecting cover 82 protects the periphery other than the plurality of heat elements 32*a* provided in the thermal print head 32.

From the above, when the head periphery-protecting cover 82 has reached the protection position P1, the operator can observe the state of the plurality of heat elements 32*a* provided in the thermal print head 32 through the opening portion 82*k* from above the head periphery-protecting cover 82.

Accordingly, a harmful stain such as deposits deposited on the plurality of heat elements 32*a* in the previous stencil making of the thermal gauze 22 can be visually checked, and the harmful stain can be cleaned before stencil making this time, and thus a stencil making operation onto the thermal gauze 22 can be favorably carried out in the stencil making this time.

Subsequently, in the second operation in the second modification of the second embodiment illustrated in FIG. 24, while the upper surface 82*a* of the head periphery-protecting cover 82 provided in the head portion 80 is pressed downward by the gauze frame 21 in a state where the platen opening/closing frame 44 in the platen portion 40 is kept open, the front end portion 21*a* of this gauze frame 21 is mounted abutting while being positioned against the positioning member 19 fixed and placed on the upper surface 11*a* of the unit housing 11. Moreover, the movable positioning member 14 movable in accordance with the length size of the gauze frame 21 is caused to abut against the rear end portion 21*b* of the gauze frame 21 while being positioned and allows the rear end portion 21*b* side of this gauze frame 21 to be mounted.

Here, when the operator presses the head periphery-protecting cover 82 downward by this gauze frame 21 while grasping the gauze frame 21, the head periphery-protecting cover 82 is pushed in while resisting the urging force of the compression spring 84 and lowered in the vertical direction.

At this time, the plurality of heat elements 32*a* provided in the thermal print head 32 advances into the opening portion 82*k* of the head periphery-protecting cover 82 and approaches the thermal gauze 22 tightly stretched in the gauze frame 21.

Next, i in the third operation in the second modification of the second embodiment illustrated in FIG. 25, the platen opening/closing frame 44 in the platen portion 40 is closed, and the head periphery-protecting cover 82 is further lowered by 15 the pressing piece 46 provided in this platen opening/closing frame 44.

Here, when the operator closes the platen opening/closing frame 44 of the platen portion 40, the platen roller 42 mounted on this platen opening/closing frame 44 comes into contact with the thermal gauze 22 tightly stretched in the gauze frame 21, and the locking claw 45 provided in the platen opening/closing frame 44 is locked to the locking pin 18 laterally provided on the inner side of the movable plate 12.

When the platen opening/closing frame 44 in the platen portion 40 is closed, the pressing piece 46 provided in this platen opening/closing frame 44 presses the head periphery-protecting cover 82 downward and thus, the head periphery-protecting cover 82 is further pushed in while resisting the urging force of the compression spring 84 and is further lowered in the vertical direction from the position illustrated in FIG. 24 and reaches the protection release position P2.

Then, the plurality of heat elements 32*a* provided in the thermal print head 32 protrudes upward from the inside of the opening portion 82*k* of the head periphery-protecting cover 82 and comes into contact with the thermal gauze 22 tightly stretched in the gauze frame 21, and thus the thermal gauze 22 is sandwiched between the plurality of heat elements 32*a* and the platen roller 42.

After that, stencil making on the thermal gauze 22 can be carried out by moving the thermal print head 32 and the platen roller 42 in the sub-scanning direction of the thermal print head 32 integrally with the movable plate 12.

It is needless to say that, when the gauze frame 21 is not set in the unit housing 11, the head periphery-protecting cover 82 is automatically returned from the protection release position P2 to the protection position P1 by the urging force of the compression spring 84.

Moreover, also in the second modification of the second embodiment, the gauze frame detection sensor (first detection sensor) and the thermal gauze detection sensor (second detection sensor), not shown, are mounted on the head base 81 in the head portion 80, and thereby the flow illustrated in FIG. 21 can be executed similarly to the first modification of the second embodiment.

In the first and second embodiments described above, there is adopted a structural form in which the thermal gauze 22 tightly stretched in the gauze frame 21 is fixed and the thermal print head 32 and the platen roller 42 are moved in the sub-scanning direction, but this is not limiting, and there can also be adopted a structural form in which the thermal print head 32 is fixed and the gauze frame 21 is moved integrally with the thermal gauze 22 in the sub-scanning direction.

Moreover, although not shown here, there can also be adopted a structural form in which, without provision of the platen roller, only the thermal print head is brought into contact with the thermal gauze for stencil making, tightly stretched by application of a gauze-strained tension in the gauze frame.

Therefore, the thermal stencil making units 10A and 10B according to the first and second embodiments of the present invention may have a structural form in which, while the thermal gauze 22 tightly stretched in the gauze frame 21 detachably set in the unit housing 11 and the thermal print head 32 having the plurality of heat elements 32*a* are relatively moved, the plurality of heat elements 32*a* is selectively heated and driven in accordance with the image information to thereby make a stencil of a perforated image on the thermal gauze 22.

At this time, the thermal print head 32 and the head-protecting cover 33 are provided on the side where the gauze frame 21 is set in order to move each of the head-protecting members 33, 60, 72, and 82 from the protection position P1 to the protection release position P2 in conjunction with the setting operation of the gauze frame 21.

Furthermore, in the first and second embodiments, although not shown here, a configuration can also be such that, for example, when the user starts the setting of the gauze frame, this gauze frame is detected by a proximity sensor placed in the unit or the like and the head-protecting member in the first and second embodiments is automatically moved by an actuator from the protection position P1 to the protection release position P2.

The above-described embodiments of the present invention are only exemplifications described in order to facilitate understanding of the present invention, and the present invention is not limited to the embodiment. A technical scope of the present invention is not limited to specific technical matters disclosed in the embodiments but also includes various modifications, changes, alternative technologies and the like which can be easily derived from there.

The present application claims priority based on Japanese Patent Application No. 2016-059631 filed on Mar. 24, 2016 and priority based on Japanese Patent Application No. 2016-145340 filed on Jul. 25, 2016 and the entire content of these applications is incorporated herein by reference.

INDUSTRIAL APPLICABILITY

According to the present invention, without generation of a human error by the operator in the setting of the gauze frame, the thermal print head can be reliably protected by the head-protecting member that has reached the protection position, and furthermore, the head-protecting member can be reliably moved from the protection position to the protection release position against the urging means in conjunction with the setting operation of the gauze frame. Moreover, when the gauze frame is not set in the unit housing, the head-protecting cover can be automatically returned from the protection release position to the protection position by the urging means.

What is claimed is:

1. A thermal stencil making unit that makes a stencil of a perforated image on a thermal gauze by selectively heating and driving a plurality of heat elements in accordance with image information while moving a thermal print head having the plurality of heat elements relative to the thermal gauze tightly stretched in a gauze frame detachably set in a unit housing, the thermal stencil making unit comprising a head-protecting member that moves between a protection position where the thermal print head is protected and a protection release position where a protective state is released, while being urged to a side of the protection position via urging means, wherein the thermal stencil making unit:

moves the head-protecting member to the protection position by the urging means, when the gauze frame is not set in the unit housing; and moves the head-protecting member against the urging means from the protection position to the protection release position, in conjunction with an operation of setting the gauze frame in the unit housing.

2. The thermal stencil making unit according to claim 1, wherein the head-protecting member is a head-protecting cover that protects the plurality of heat elements at the protection position;

the head-protecting cover is integrally provided with a pressing member; and when the thermal print head and the head-protecting cover are provided in the unit housing and the gauze frame is set in the unit housing, the pressing member presses the head-protecting cover from the protection position toward the protection release position by one end portion of the gauze frame in a setting direction.

3. The thermal stencil making unit according to claim 2, wherein when a platen portion that supports a platen roller capable of being pressed on a side of the thermal print head via the thermal gauze is provided in the unit housing, capable of being opened and closed, the pressing member is provided at least on one end portion side of both end portion sides in a direction orthogonal to the setting direction of the gauze frame on the head-protecting cover.

4. The thermal stencil making unit according to claim 1, wherein the head-protecting member is a head periphery-protecting cover that has an opening portion through which the plurality of heat elements advances and retreats and that protects the thermal print head at the protection position in a periphery of the plurality of heat elements on an advance direction side of the gauze frame; and wherein when the gauze frame is set in the unit housing, the gauze frame is pressed while resisting an urging force of the urging means, against the head periphery-protecting cover having reached the protection position, and the head periphery-protecting cover is moved from the protection position to the protection release position.

5. The thermal stencil making unit according to claim 4, wherein the head periphery-protecting cover is movably provided in a vertical direction between the protection position and the protection release position;

the plurality of heat elements is moved by the urging force of the urging means to the protection position while facing the inside of the opening portion and waits for the setting of the gauze frame; and the plurality of heat elements is pushed in by the gauze frame while resisting the urging force of the urging means in the setting of the gauze frame and is moved to the protection release position where the plurality of heat elements protrudes upward from the inside of the opening portion.

6. The thermal stencil making unit according to claim 1, further comprising:

a first detection sensor configured to detect that the gauze frame is set by the head-protecting member when the head-protecting member has moved from the protection position to the protection release position; and a second detection sensor configured to detect the presence or absence of the thermal gauze when the gauze frame is set in the unit housing.

* * * * *